US011518660B1

(12) United States Patent
Higgins, Sr.

(10) Patent No.: US 11,518,660 B1
(45) Date of Patent: Dec. 6, 2022

(54) APPARATUS AND METHOD FOR HANDLING CARGO

(71) Applicant: Pro-Tech Group LLC, Southfield, MI (US)

(72) Inventor: Earle B. Higgins, Sr., Farmington Hills, MI (US)

( * ) Notice: Subject to any disclaimer, the term of this patent is extended or adjusted under 35 U.S.C. 154(b) by 467 days.

(21) Appl. No.: 16/711,421

(22) Filed: Dec. 11, 2019

(51) Int. Cl.
*B66F 9/065* (2006.01)
*B66F 9/075* (2006.01)
*B66F 9/16* (2006.01)

(52) U.S. Cl.
CPC ..... *B66F 9/0655* (2013.01); *B66F 9/0759* (2013.01); *B66F 9/07504* (2013.01); *B66F 9/07572* (2013.01); *B66F 9/16* (2013.01)

(58) Field of Classification Search
CPC ..... B66F 9/065; B66F 9/0655; B66F 9/06; B66F 9/061; B66F 9/07504; B66F 9/07572; B66F 9/0759; B66F 9/16; E02F 9/166; B62D 33/063
See application file for complete search history.

(56) References Cited

U.S. PATENT DOCUMENTS 2,199,095 A * 4/1940 Banker ..... F16H 61/0293 74/516
3,229,602 A * 1/1966 Vivier ..... E01C 19/27 280/43.23
3,665,787 A * 5/1972 Wilkinson ..... F02B 33/34 123/561
4,790,711 A * 12/1988 Calaway ..... B62D 33/0633 180/326
7,383,906 B2 * 6/2008 Sewell ..... E02F 9/02 212/253
2004/0151568 A1 * 8/2004 Bellchambers ..... B66F 9/0755 414/699

* cited by examiner

*Primary Examiner* — Tyrone V Hall, Jr.

(57) ABSTRACT

An apparatus (100) and method (900) for the handling of cargo (70). The apparatus (100) includes a cab assembly (400) and a loader assembly (600) mounted onto a mobile mounting structure (200). The apparatus (100) can be particularly useful in the context loading and unloading cargo (70) in tight and confined spaces, such as the loading and unloading collapsible containers (84) into rail cars used to deliver cars and small trucks. The cab assembly (400) can have a horizontal rotation range (284) of up to about 180 degrees, so that the operator (90) of the apparatus (100) can avoid driving in reverse.

19 Claims, 24 Drawing Sheets

400

APPARATUS AND METHOD FOR HANDLING CARGO

BACKGROUND OF THE INVENTION

The invention relates generally to the apparatuses and methods for handling cargo (the "apparatus"). The apparatus can be particularly useful in the context of handling railcar freight.

According to the Railway Supply Institute, the railway supply industry contributed $74.2 billion dollars (US) to the gross domestic product of the United States. According to the Association of American Railroads, the U.S. Department of Transportation expects total freight demand in the United States to grow 35% by 2040.

Rail is particularly important to the auto industry, where according to the Association of American Railroads, freight rail moves nearly 75% of the new cars and light trucks purchase in the United States. Automobiles must arrive at the dealerships in pristine condition, which is incentivized the rail industry to use dedicated trains and railcars to move finished automobiles from assembly plants to their destinations.

The practice of using specialized and dedicated railcars to transport new cars and light trucks is a necessary limitation to ensure that vehicles arrive at dealerships in a sufficiently pristine condition. However, these limitations have a significant economic opportunity cost. With current policies and prior art equipment, such specialized railcars are empty on their return trip back to the automotive assembly plants.

It would be desirable for the railcars used to ship new vehicles to dealerships to also be filled with useful cargo on their return trips. This would reduce the cost of shipping the finished vehicles by rail, as there would be other additional revenues to be derived from the same two-way trip.

The apparatus is described in greater detail below in the Summary of the Invention section.

SUMMARY OF THE INVENTION

The invention relates generally to the apparatuses and methods for handling cargo (the "apparatus"). The apparatus can be particularly useful in the context of handling railcar freight.

The apparatus has a cab assembly and a loader assembly, both of which are mounted onto a mounting structure. The cab assembly can have a rotation capability of up to about 180 degrees, so that the operator/driver of the apparatus can always be facing the direction in which the apparatus is being driven. The apparatus can also be sized and dimensioned so that it can be driven into and out of tight locations, such as railcars, facilitating the ability of the apparatus to load and unload railcars.

The apparatus can be better understood by referencing the drawings discussed below.

BRIEF DESCRIPTION OF THE DRAWINGS

Different examples of various attributes, components, and configurations that can be incorporated into the apparatus are illustrated in the drawings described briefly below. No patent application can expressly disclose in words or in drawings, all of the potential embodiments of an invention. In accordance with the provisions of the patent statutes, the principles, functions, and modes of operation of the system are illustrated in certain preferred embodiments. However, it must be understood that the apparatus may be practiced otherwise than is specifically illustrated without departing from its spirit or scope.

Figure 1A:
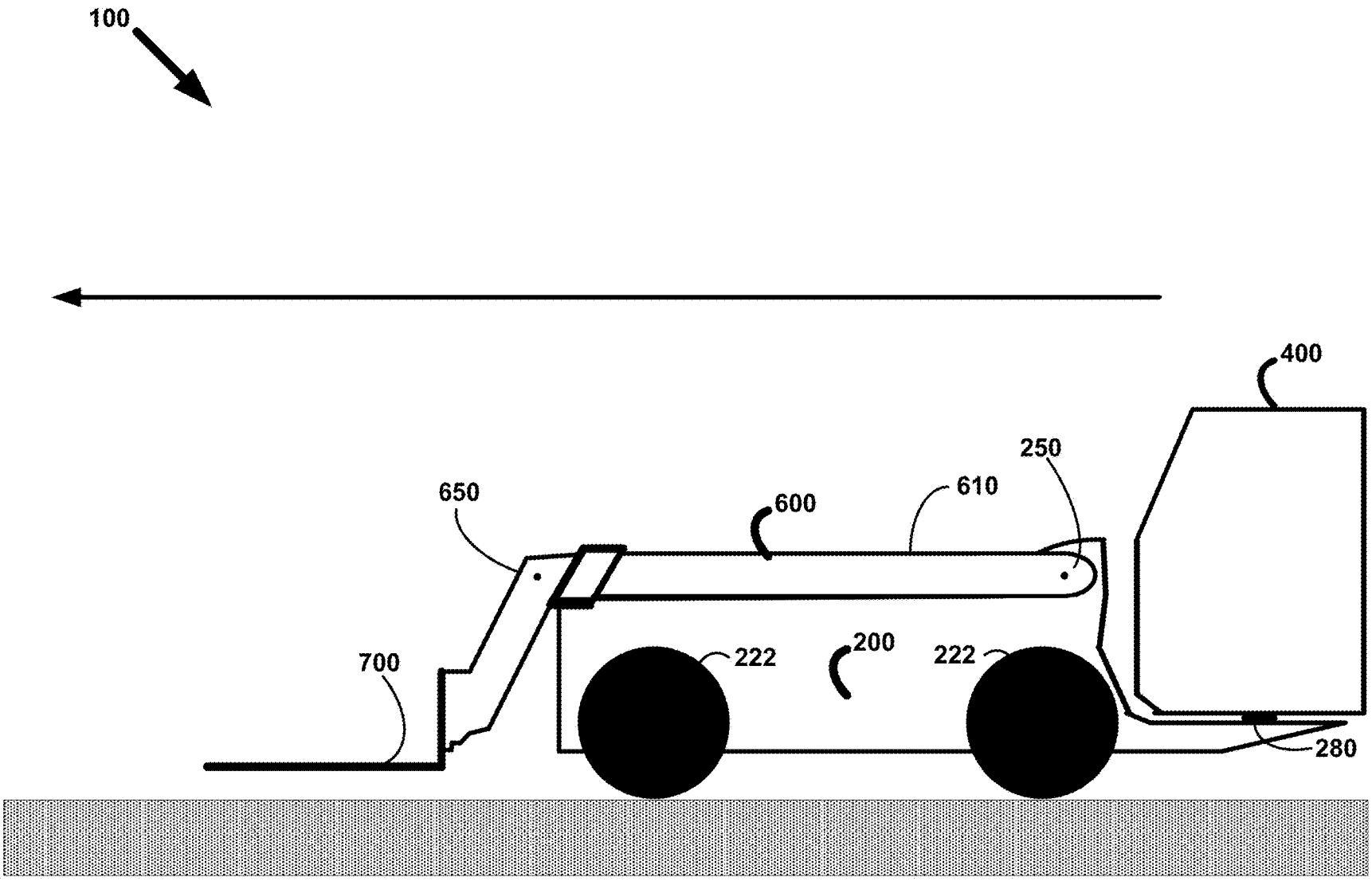
FIG. 1A is a side view diagram of the apparatus illustrating an example of the apparatus with loader assembly in a lowered position and front of the cab assembly facing towards the loader assembly.

The system can be further understood by the text description provided below in the Detailed Description section.

DETAILED DESCRIPTION

The invention relates generally to the apparatuses and methods for handling cargo (the "apparatus"). The apparatus can be particularly useful in the context of handling railcar freight. All element numbers and associated terminology referenced below are listed and defined in Table 1 below.

I. Overview

Many industries rely on rail-based transportation to move components to assembly plants and finished products to stores where they can be purchased by consumers. The auto industry is particularly dependent using rail transportation to transport cars and small trucks from assembly plants to dealerships through the country. Such vehicles are typically shipped in specialized rail cars that are used for the exclusive purpose of transporting vehicles. This keeps the vehicles from being damaged in transit, so that vehicles in pristine condition can be delivered to auto dealerships. The downside to this prior art practices is that those same exclusive purpose and specialized rail cars are empty on the return trip back from the point of delivery/unloading back to the assembly plants. This represents economic waste to the rail industry and costs that are ultimately amortized over the vehicles that are shipped via rail.

The motivation for conception of the apparatus was to eliminate the practice of empty railcars on the return trip after dropping off vehicles from assembly plants for auto dealerships. Elimination of this expensive practice can be achieved through a couple of different technologies. U.S. Pat. No. 9,016,490 to Earle B. Higgins titled "MODULAR CONTAINER SYSTEM" discloses and claims a collapsible container 84 with a low footprint in collapsed mode that can be used to carry cargo in a car-hauling rail car when the car-hauling rail car has been emptied to vehicles. The modular container system can then be collapsed into a low footprint state when vehicles are picked up from the can be used to carry cargo.

Another tool to eliminate the practice of empty car-hauling rail cars after the unloading of vehicles is the apparatus 100. The apparatus 100 includes a cab assembly 400 and a loader assembly 600 that are mounted on a mounting structure 200. The mounting structure 200 forms the body of drivable vehicle with wheels 222 or some other form of motion components 220. The cab assembly 400 can rotate up to about 180 degrees, so that the operator 90 of the apparatus 100 need never drive in reverse—the operator 90 can always rotate the cab assembly 300 so that the operator 90 is facing the direction in which the apparatus 100 is being driven. The apparatus 100 can be built in smaller dimensions that other similar loading vehicles. This combination of attributes can enable the apparatus 100 to be driven into and out of car-hauling rail cars, even if such cars are bi-level or tri-level.

The apparatus 100 in conjunction with collapsible containers 84 can decrease the cost of rail freight by eliminating the waste of empty car-hauling rail cars. Tens of millions of dollars can be saved each year by increasing the utilization of what is now wasted space of empty car-hauling rail cars. The prior art practice of empty car-hauling rail cars is well established. As are the dimensions and size of loader vehicles, which are too large for maneuvering within a car-hauling rail car.

The freight rail industry has always been measured by time. At the outset, it was a uniform system to mediate time differences across the United States and build reliability into an erratic and rapidly expanding rail network. Railroad time remains a lasting standard, but the apparatus 100 in conjunction with the modular collapsible container 84 represent a change in focus to the elimination or reduction of empty miles by auto railcars. This is particularly important given that automobile manufacturers (OEMs) use specialized multi-level automobile transport railcars (auto racks 62) to transport finished vehicles to markets across the United States, Canada and Mexico. Auto racks 62 are not designed to ship anything other than vehicles and are often dead-headed (i.e. empty) on the return trip.

Only recently did the collapsible containers 84 invented by the applicant become the first containers 80 ever certified and approved for shipping goods on pallets using auto racks 82. Those collapsible containers 84 are designed to hold two full pallets and can be used to transport any goods currently shipped by pallets on railcars 62, except for hazardous materials. Auto racks 62 loaded with the collapsible containers 84 can and will compete with trucks and other railroad cars currently used to haul goods on pallets.

II. Alternative Embodiments

Different examples of various attributes, components, and configurations that can be incorporated into the apparatus 100 and its operating environment are illustrated in the drawings and described in Table 1. and de. However, no patent application can expressly disclose in words or in drawings, all of the potential embodiments of an invention in a comprehensive manner. In accordance with the provisions of the patent statutes, the principles, functions, and modes of operation of the apparatus 100 are illustrated in certain preferred embodiments. However, it must be understood that the apparatus 100 may be practiced otherwise than is specifically illustrated without departing from its spirit or scope.

II. Glossary of Terms

All terminology associated with an element number is defined in Table 1 below.

TABLE 1

| Element Number | Element Name | Element Definition/Description |
|---|---|---|
| 60 | Freightcar or Freight Car | A car pulled by a train that is not self-propelled and that is used to transport freight. |
| 62 | Auto-Rack | A freight car 60 that is used to transport cars and light trucks. |
| 70 | Cargo | Goods or merchandize moved by a vehicle such as a train or an apparatus 100. |
| 80 | Container | An object that is constrain the position of cargo 70 while it is being transported. |
| 84 | Collapsible Container | A container 80 that can be collapsed and/or compressed in order to take up less space when it is not in use. The modular container disclosed in U.S. Pat. No. 9,016,490 is an example of a collapsible container. |
| 90 | User/Operator | A user/operator who controls the operation of the apparatus 100. In the future, automated technologies analogous to self-driving vehicles and industrial robots may be the operators 90 of the apparatus 100. |
| 100 | APPARATUS | A vehicle that can be used to load and unload cargo 70. The apparatus 100 includes a cab assembly 400 and a loader assembly 600 that are mounted onto a mounting structure 200 which moves using one or more motion components 220, such as wheels 222. |
| 200 | Mounting Structure | An assembly and configuration of components that support the cab assembly 400 and the loader assembly 600. |
| 210 | Base Member | The main body that makes up the mounting structure 200. |
| 220 | Motion-Enabling Component | A component such as a wheel 222 or tread 226 that enables the base member 210, mounting structure 200, and apparatus 100 as a whole to move. |
| 222 | Wheel | A circular object the revolves on an axle and is fixed below a vehicle or other object to enable it to move easily over the ground. |
| 226 | Tread or Track | A motion-enabling component 220 used on snowmobiles and tanks. |
| 250 | Loader Base | A configuration of components on the mounting structure 200 that support the loader assembly 600. The loader base 250 supports the motion of the loader assembly 600 relative to the mounting structure 200. By way of example, the loader assembly 600 can be raised and extended to load and unload cargo 70. |
| 252 | Vertical Pivot Point | The portion of the loader base 250 that enables the vertical motion of the loader assembly 600. |
| 280 | Cab Base | A configuration of components on the mounting structure 200 that support the cab assembly 400. |
| 282 | Horizontal Rotation Point | The portion of the cab base 280 that enables the horizontal motion of the cab assembly 400 relative to the base member 210, mounting structure 200, and apparatus 100 as a whole. |
| 300 | Engine | A machine that converts energy into mechanical force and motion. In addition to powering the movement of the apparatus 100, the engine 300 also powers the movement of the cab assembly 400 and the loader assembly 600. |
| 310 | Turbo-Charged Engine | A turbine-driven forced induction device that increases an internal combustion engine's efficiency and power output by forcing extra compressed air into the combustion chamber. |

TABLE 1-continued

| Element Number | Element Name | Element Definition/Description |
|---|---|---|
| 320 | Diesel | An internal combustion engine in which heat produced by the compression of air in the cylinder is used to ignite the fuel. |
| 350 | Transmission | The mechanism by which power is transmitted from an engine to the wheels of a motor vehicle. |
| 352 | Hydrostatic Transmission | A transmission where a hydraulic pump is connected to one or more hydraulic motors. These transmissions produce a speed-torque characteristic that is hyperbolic. |
| 354 | Speed Range | A continuum of permitted driving speeds for the apparatus 100. By limiting the speeds of the apparatus 100, the safety and accuracy of the apparatus 100 as a loading tool in close quarters can be enhanced. |
| 356 | Auto-Shift | A transmission 350 that can automatically shift gears. |
| 360 | Speed Management Subassembly | A subassembly for controlling the speed and motion of the apparatus 100 as a vehicle, and of the loader assembly 600 as a tool for loading and unloading cargo 70. |
| 370 | Dynamic Brake | Dynamic braking is the use of an electric traction motor as a generator when slowing a vehicle such as an electric or diesel-electric locomotive. It is termed "rheostatic" if the generated electrical power is dissipated as heat in brake grid resistors, and "regenerative" if the power is returned to the supply line. |
| 372 | Inching Pedal | A mechanism that enables the apparatus to be slowed down or stopped while at the same time the engine speed is used to lift the load. |
| 374 | Mechanical Gearbox | The gearbox is a mechanical method of transferring energy from one device to another and is used to increase torque while reducing speed. |
| 376 | 4-Speed Mechanical Gearbox | A mechanical gearbox with 4 set speeds. |
| 400 | Cab Assembly | A chamber in the apparatus 100 where the operator 90 sits to control the apparatus 100. The cab assembly 400 can rotate up to about 180 degrees. |
| 410 | Rotation Axel Scope | The range of horizontal rotation of the cab assembly 400. In a preferred embodiment, the rotation axel scope is up to about 180 degrees. |
| 420 | Work Light | An external lamp for illuminating the exterior operating environment of the apparatus 100. |
| 430 | Window | A transparent surface comprised of either plastic, glass, plexiglass, or some other similar substance. Windows 430 can also function as walls |
| 432 | Glass Window | A window 430 that is comprised of glass. |
| 440 | Pillar | A support member. In a preferred embodiment of the apparatus 100, four pillars 440 support a roof of the apparatus 100. Those same four pillars 440 secure the position of four windows 430. |
| 450 | Controls | A device or mechanism for operating the apparatus 100. Examples of controls 450 can include buttons, knobs, pedals, dials, steering wheels, joysticks, etc. |
| 460 | Seat | A chair on which the operator 90 sits while driving the apparatus 100. |
| 470 | Sensor | A device that captures information about the operating environment of the apparatus 100. Examples of sensors 470 can include cameras 472, microphones, GPS, thermostats, motion detectors, distance detectors, etc. |
| 472 | Camera | A sensor 470 that captures information in the form of visual images. Cameras 472 positioned on the apparatus 100 can assist the operator 90 in unloading/loading the apparatus 100 as well as in driving the apparatus 100. |
| 474 | Display | A screen upon which the images or video of a camera 472 can be viewed. |

TABLE 1-continued

| Element Number | Element Name | Element Definition/Description |
|---|---|---|
| 600 | Loader Assembly | A configuration of subassemblies and parts that are used to perform the function of loading and unloading the apparatus 100. The loader assembly 600 includes a boom 600 (the lower arm), the lift arm handler (the upper arm), and the loader 700 (the hand). |
| 610 | Boom | An arm that collectively protrudes from the turret 616. The boom 610 is the base of the loader assembly 600. The boom 610 is supported by the loader base 250. |
| 612 | Cushion Subassembly | A subassembly to smooth over/cushion the movements of the loader assembly 600. |
| 614 | Boom Angle | The vertical angle between the boom 610 and the top of the base member 210. |
| 616 | Turret | The mechanism by which the boom 610 and the loader assembly 600 move relative to the apparatus 100. |
| 650 | Lift Arm/ Handler | A portion of the loader assembly 600 that can extend or contract, using the telescopic extension 658. |
| 652 | Turn Radius | The range of left-right rotation that can be implemented by the loader 700. |
| 654 | Tilt Angle | The angle at which the fork 712 can tilt. |
| 656 | Telescopic Lift Arm/Handler | The portion of the loader assembly 700 that powers the lift/extension or contraction of the telescopic extension 658. |
| 658 | Telescopic Extension | The telescoping member of the lift arm/handler 650. |
| 660 | Backrest | A support structure on the loader assembly 600. |
| 670 | Axle | A rod or spindle in the loader assembly 600. |
| 672 | Heavy-Duty Axle | A structurally reinforced axle 670 to support the loading/unloading capacity of the loading assembly 600. |
| 680 | Gear | A set of toothed wheels that work together in the movement of the loader assembly 600 and is subassemblies and components. |
| 682 | Central Differential Gear | A gear train with three shafts of differing sizes and speeds. |
| 684 | Planetary Gear | A gear system using one or more outer/planet gears around an inner/sun gear. |
| 690 | Steering Cylinder | A cylinder in the space of where a piston travels. It can be an important working component of a reciprocating engine. A durable surface keeps the engine from seizing. |
| 700 | Loader | The configuration of components making up the loader assembly 700 that support the cargo 70 when the cargo 70 is on the apparatus 100. |
| 702 | Roll | Mechanism by which the fork 710 is vertically tilted so that cargo 70 on the fork 710 slides off the fork 710 in the unloading process. |
| 705 | Fork Tilt | Vertical movement of the fork 710 as a whole that can be measured as an angle. |
| 710 | Fork | Members on which cargo 70 rests when cargo is moved by the apparatus 100. |
| 712 | Self-Leveling Fork | A fork 710 with a swivel mechanism that keeps the fork 710 level. |
| 800 | Mode | A condition or status of the apparatus 100. In some embodiments of the apparatus 100, there are mutually exclusive modes of steering 810 and handling 820. |
| 810 | Steering Mode | A mode 800 where the mounting structure 200 is able to move but the loading assembly 600 is fixed. |
| 820 | Handling Mode | A mode 800 where the loading assembly is able to move relative to the mounting structure 200, and the mounting structure 200 is unable to move. |
| 830 | Position | A configuration and location of the loader assembly 600. |
| 832 | Extended Position | A loader assembly 700 positioned in an elongated position, either vertically and/or horizontally. |

TABLE 1-continued

| Element Number | Element Name | Element Definition/Description |
|---|---|---|
| 834 | Retracted Position | A loader assembly 700 in a compressed position. |
| 900 | METHOD | A process of loading and/or unloading cargo 70 that uses the apparatus 100. |

III. Loading and Unloading of Apparatus

The apparatus 100 was conceptualized to address the problem of unused railcar space in the context of railcars used exclusively for the transport of cars and light trucks. As discussed above, the operating parameters of the apparatus 100 were conceived of to specifically enable the use of collapsible containers 84 that would be filled and loaded in railcar space that would otherwise be used exclusively for automotive vehicles. Such railcar space is needlessly empty without the use of the modular collapsible containers 84 in conjunction with a loader apparatus 100 small and agile enough to maneuver into and out of such a railcar. The apparatus 100 can also have a cab assembly 400 with a horizontal rotation capability of up to about 180 degrees, so that the operator 90 of the apparatus 100 can always drive in the direction that the operator 90 is facing. This combination of attributes can enable the efficient, safe, and widespread utilization of railcar space that would otherwise go unutilized.

FIGS. 1A through 1H illustrate a sequence of images that illustrate an apparatus 100 riding to unload cargo 70 from a source (i.e. load the cargo 70 on the apparatus 100), moving the cargo 70 to the desired location, unloading the cargo 70, and then returning to repeat the process.

A. Driving to Pick-Up Cargo

FIG. 1A is a side view diagram of the apparatus 100 illustrating an example of the apparatus 100 with loader assembly 600 in a lowered position and front of the cab assembly 400 facing towards the loader assembly 600. As indicated by the leftward arrow in the Figure, the apparatus 100 is moving in a leftward direction. The apparatus 100 is in steering mode 810, not handling mode 820.

B. Picking-Up Cargo

Figure 1B:
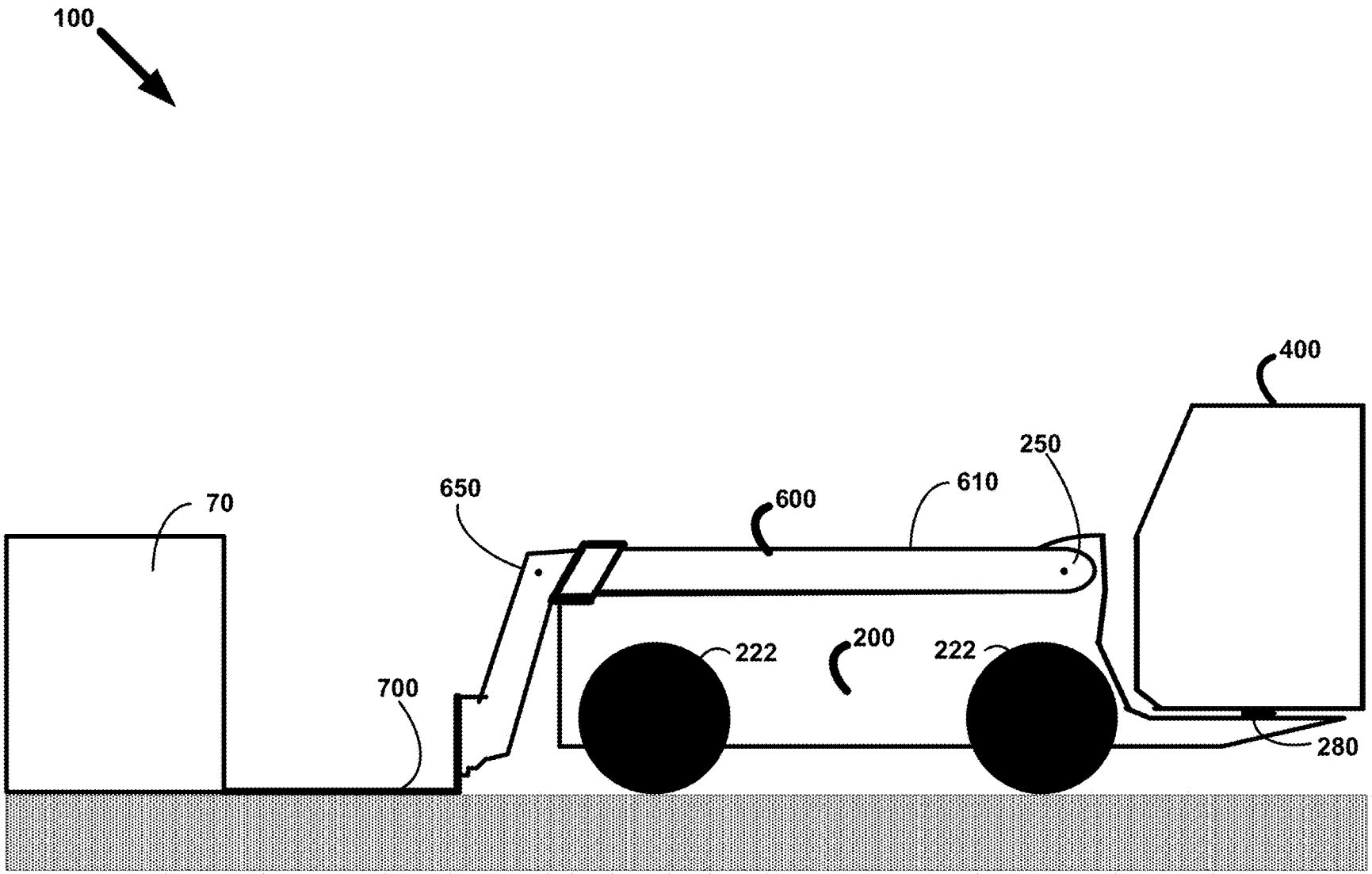
FIG. 1B is a side view diagram of the apparatus illustrating an example of the apparatus in FIG. 1A, with the loader assembly subsequently fully lowered to pick up cargo.

FIG. 1B is a side view diagram of the apparatus illustrating an example of the apparatus 100 in FIG. 1A, with the loader assembly 600 subsequently fully lowered to pick up cargo 70. The cab assembly 400 remains facing towards the loader assembly 600 and the cargo 70. The apparatus 100 is in handling mode 820 not steering mode 810.

Figure 1C:
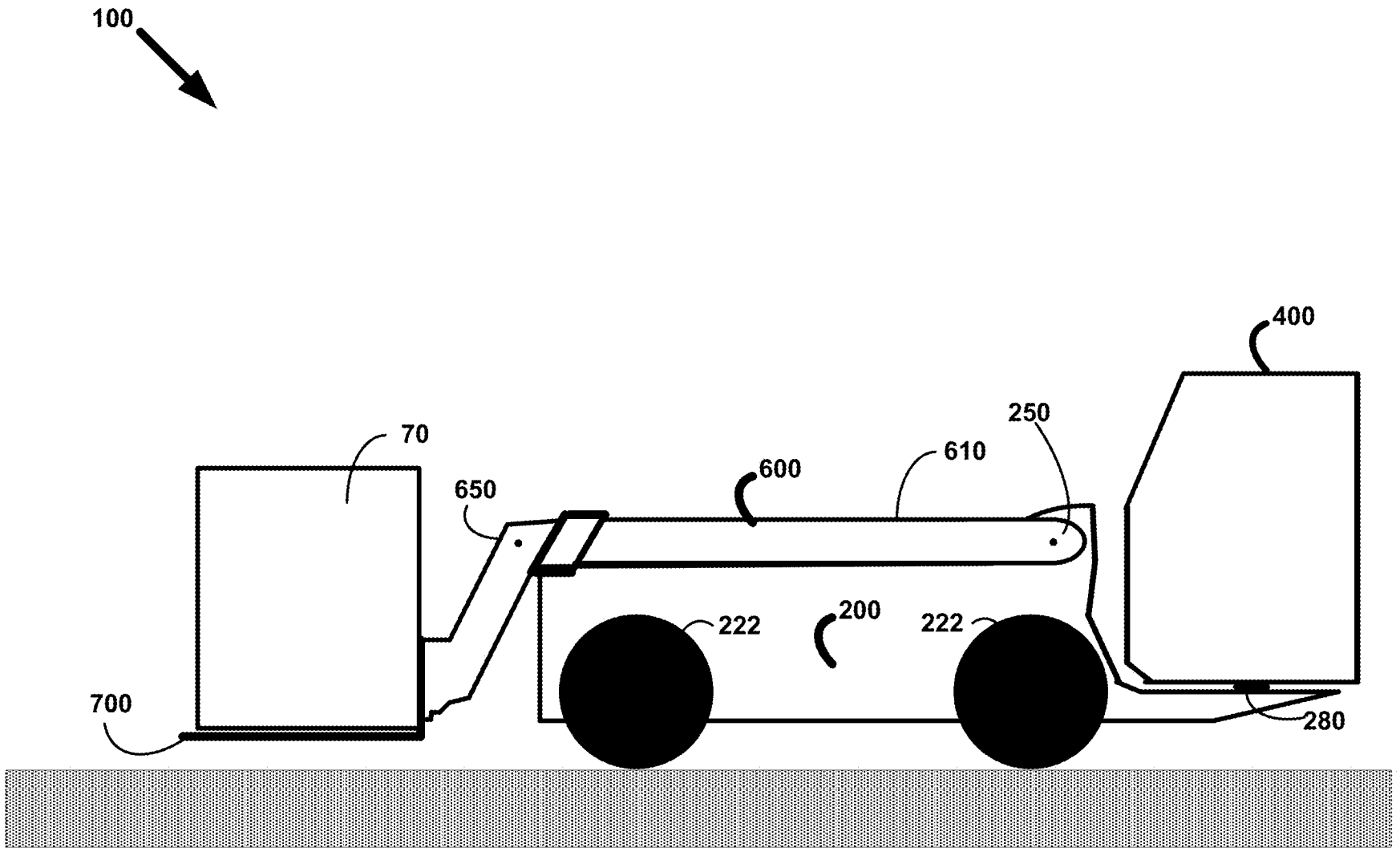
FIG. 1C is a side view diagram of the apparatus illustrating an example of the apparatus in FIG. 1B, with the loader assembly subsequently raised so that the apparatus is enabled to move without dragging the cargo.

FIG. 1C is a side view diagram of the apparatus 100 illustrating an example of the apparatus 100 in FIG. 1B, with the loader assembly 600 subsequently raised so that the apparatus 100 is enabled to move without dragging the cargo 70. The apparatus 100 is in handling mode 820 not steering mode 810.

C. Rotating Cab Assembly

Figure 1D:
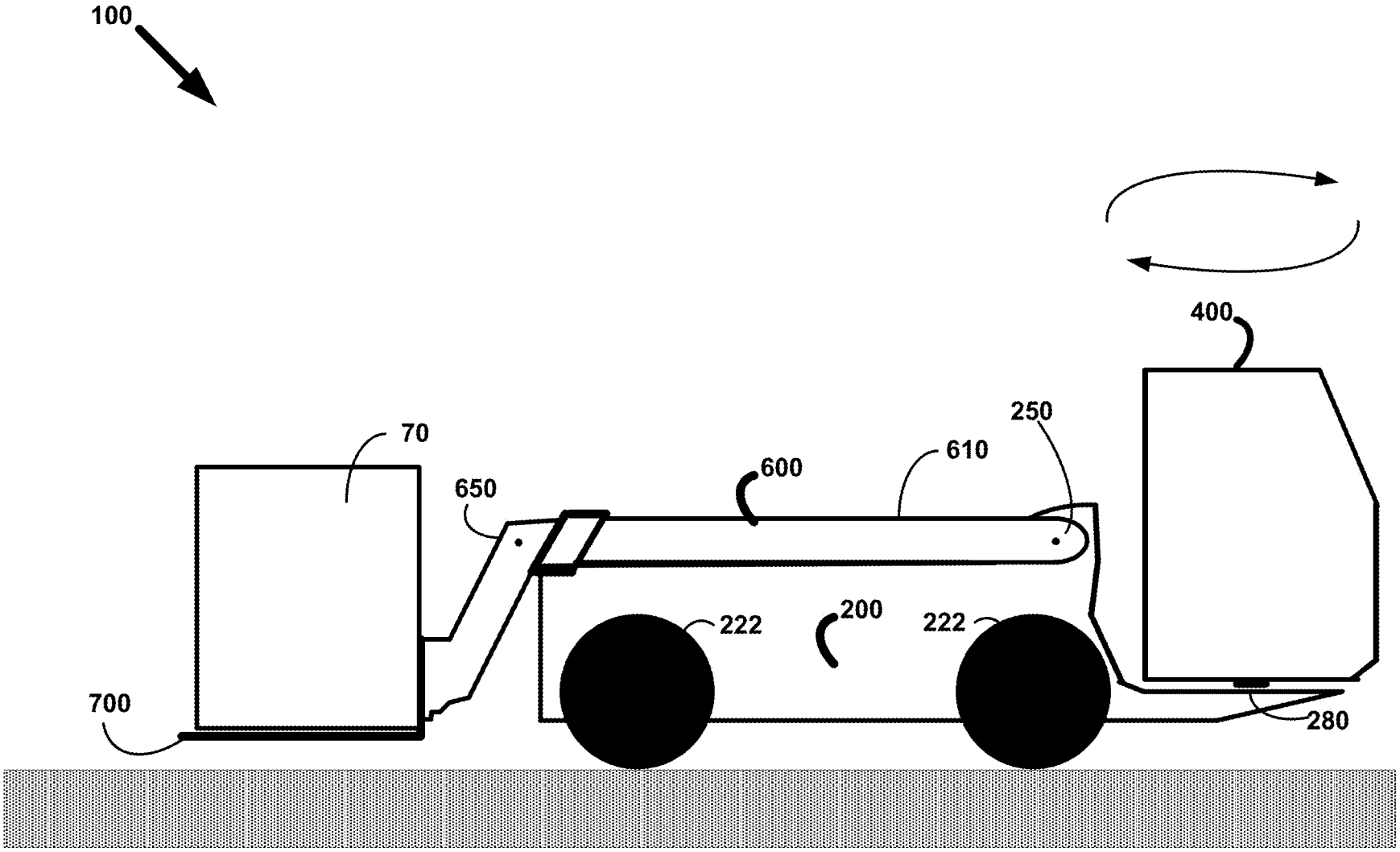
FIG. 1D is a side view diagram of the apparatus illustrating an example of the apparatus in FIG. 1C, with the cab assembly subsequently rotated to face away from the loader assembly so that the front of the cab assembly will face the direction of future movement.

FIG. 1D is a side view diagram of the apparatus 100 illustrating an example of the apparatus 100 in FIG. 1C, with the cab assembly 500 subsequently rotated to face away from the loader assembly 600 so that the front of the cab assembly 400 will face the direction of future movement. The apparatus 100 is about to enter steering mode 810.

D. Leaving the Railcar/Confined Area

Figure 1E:
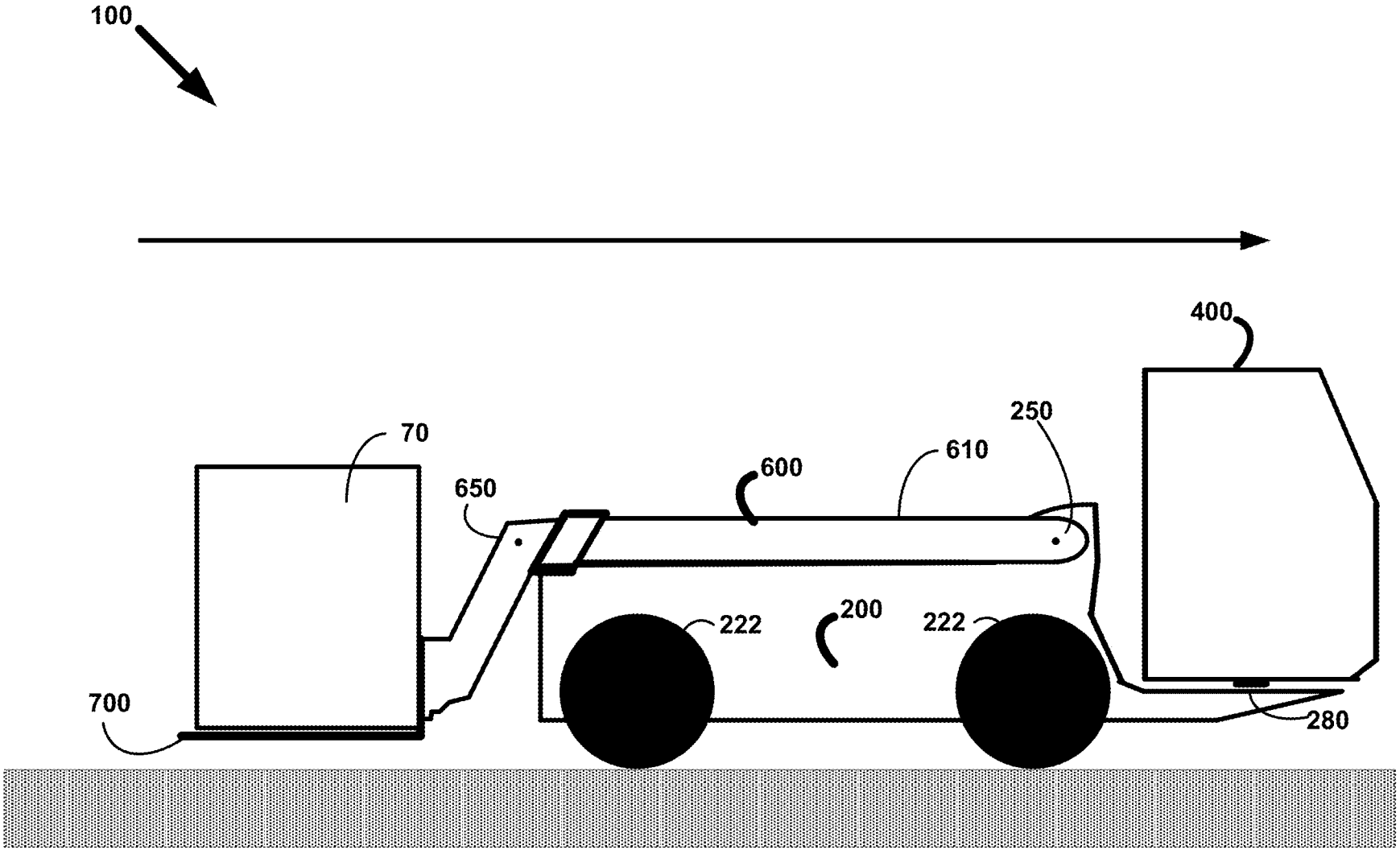
FIG. 1E is a side view diagram of the apparatus illustrating an example of the apparatus in FIG. 1D, with the apparatus subsequently moving in the direction that the cab assembly is facing.

FIG. 1E is a side view diagram of the apparatus 100 illustrating an example of the apparatus 100 in FIG. 1D, with the apparatus 100 subsequently moving in the direction that the cab assembly 400 is facing. The apparatus 100 is in steering mode 810, driving in a rightward direction as indicated by the arrow above the apparatus 100. In the case of a railcar or other very narrow space, the apparatus 100 must get out of the spatially limited area before driving towards the destination for the cargo 70.

E. Driving Off with the Cargo

Figure 1F:
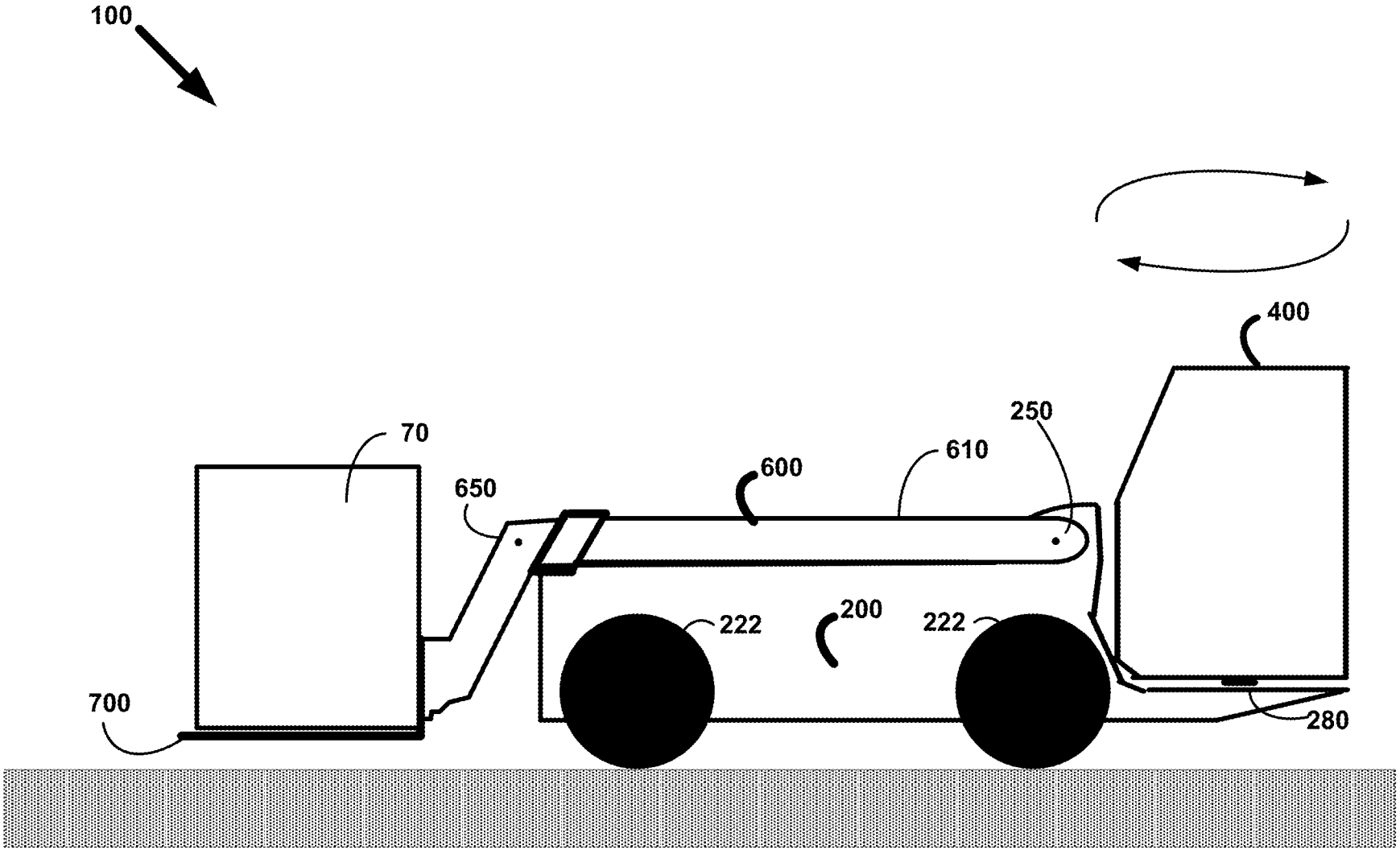
FIG. 1F is a side view diagram of the apparatus illustrating an example of the apparatus in FIG. 1E, with the cab assembly subsequently rotated towards the loader assembly to enable the apparatus to be driving with the loader assembly at the front of the apparatus and the cab assembly facing the direction of movement.

FIG. 1F is a side view diagram of the apparatus 100 illustrating an example of the apparatus 100 in FIG. 1E, with the cab assembly 400 subsequently rotated towards the loader assembly 600 to enable the apparatus 100 to be driving with the loader assembly 600 at the front of the apparatus 100 and the cab assembly 400 facing the direction of movement. After having "backed out" of the confined area, the cab assembly 400 has been rotated once again to face the direction in which the apparatus 100 is being driven.

F. Delivering Cargo to Destination

Figure 1G:
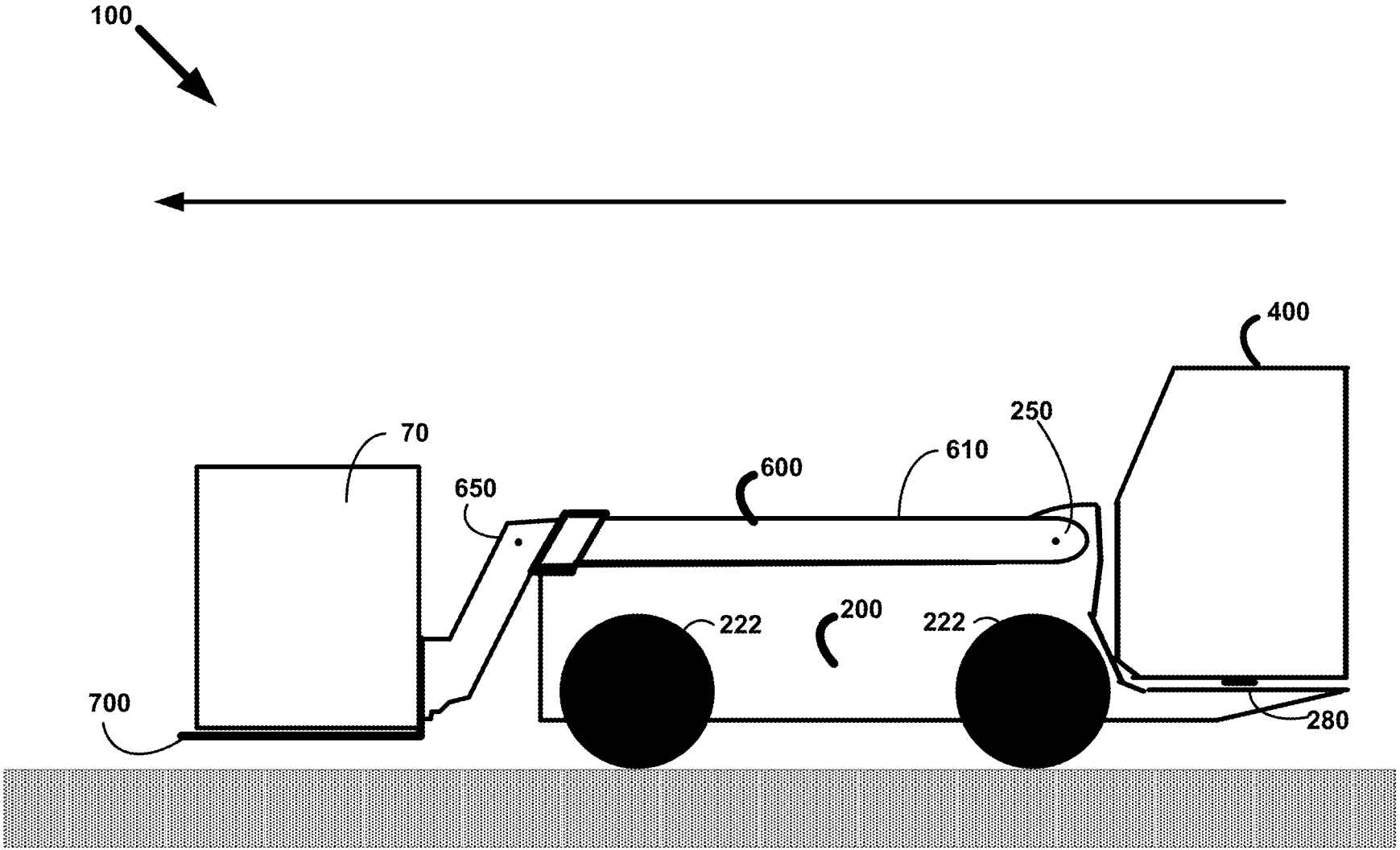
FIG. 1G is a side view diagram of the apparatus illustrating an example of the apparatus in FIG. 1F, with the cab assembly subsequently moving to unload the cargo.

FIG. 1G is a side view diagram of the apparatus 100 illustrating an example of the apparatus 100 in FIG. 1F, with the cab assembly 400 subsequently moving to unload the cargo 70.

G. Unloading the Cargo at the Destination

Figure 1H:
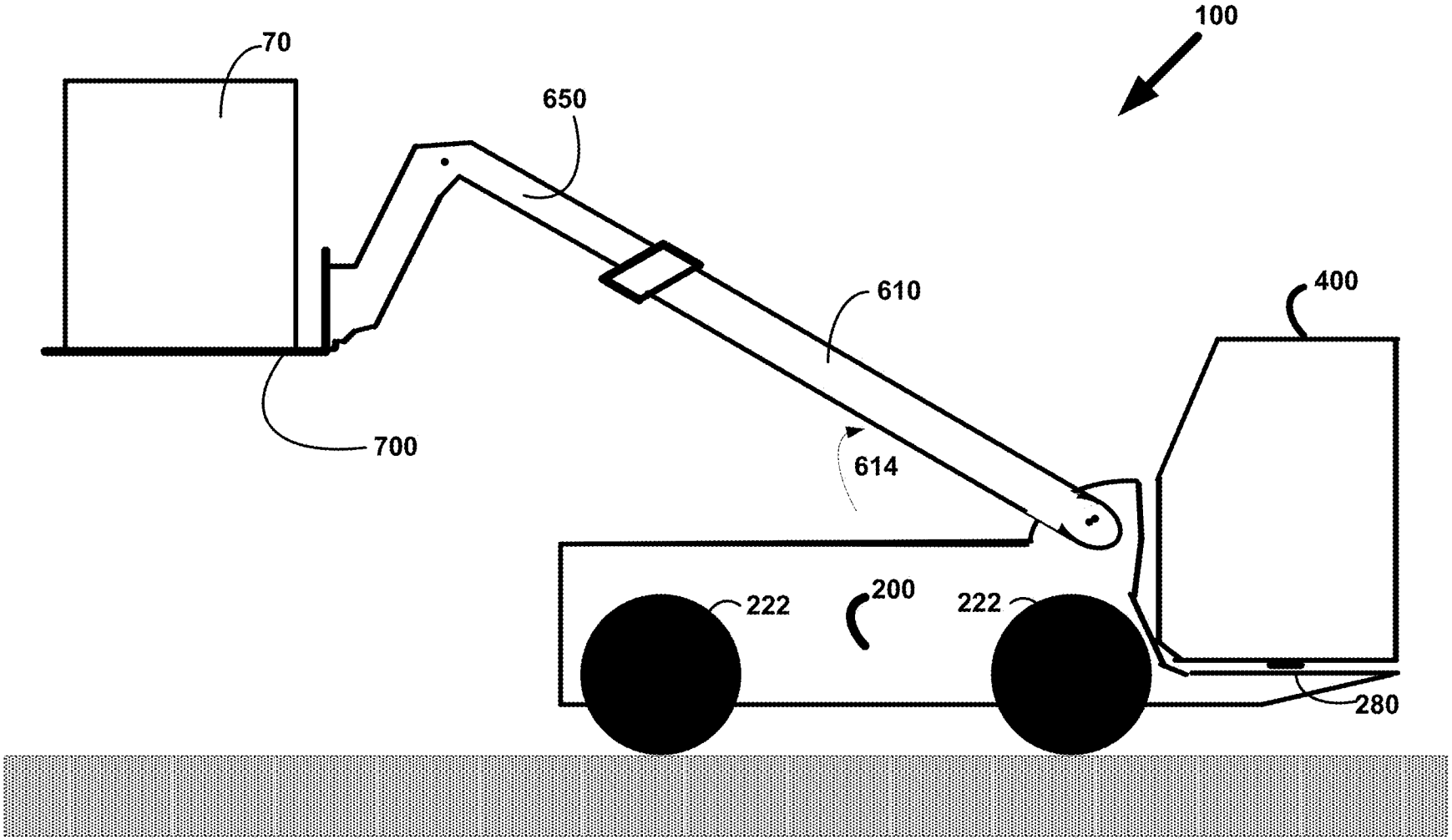
FIG. 1H is a side view diagram of the apparatus illustrating an example of the apparatus in FIG. 1G, with the loader assembly subsequently raised in preparation of unloading the cargo.

FIG. 1H is a side view diagram of the apparatus 100 illustrating an example of the apparatus 100 in FIG. 1G, with the loader assembly 600 subsequently raised in preparation of unloading the cargo 70.

The process illustrated from FIG. 1A through FIG. 1H can repeat as the apparatus 100 is used to load and unload cargo from confined spaces, such as a railcar.

IV. Core Components

Figure 2:
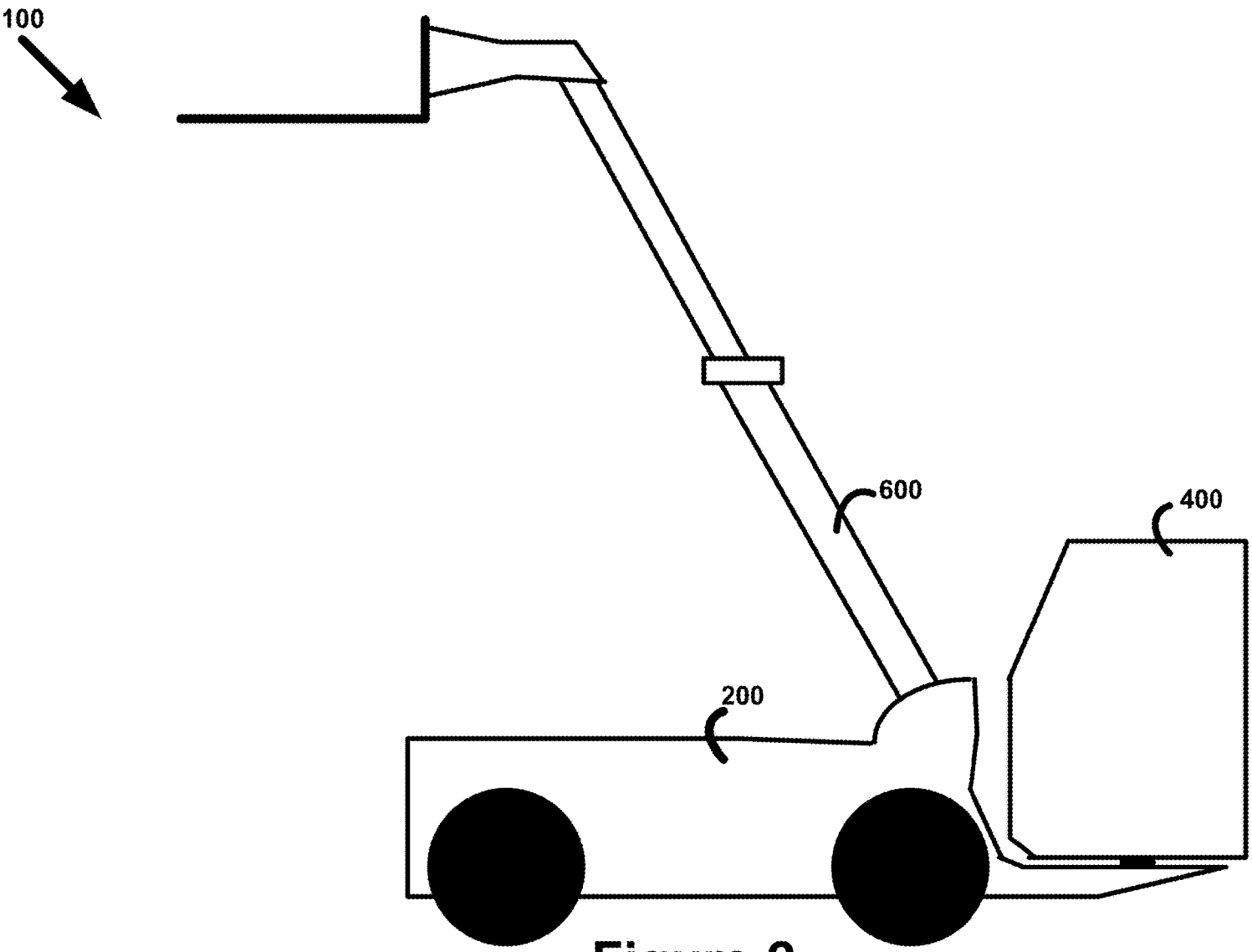
FIG. 2 is a side view diagram illustrating an example of the apparatus with a fully raised and extended loader assembly and a cab assembly facing the loader assembly. This is the configuration of the apparatus that will often occur immediately prior to loading cargo onto the loader assembly. This drawing also illustrates an example of three core subassemblies of the apparatus, a mounting structure, a cab assembly, and a loader assembly.
Figure 3:
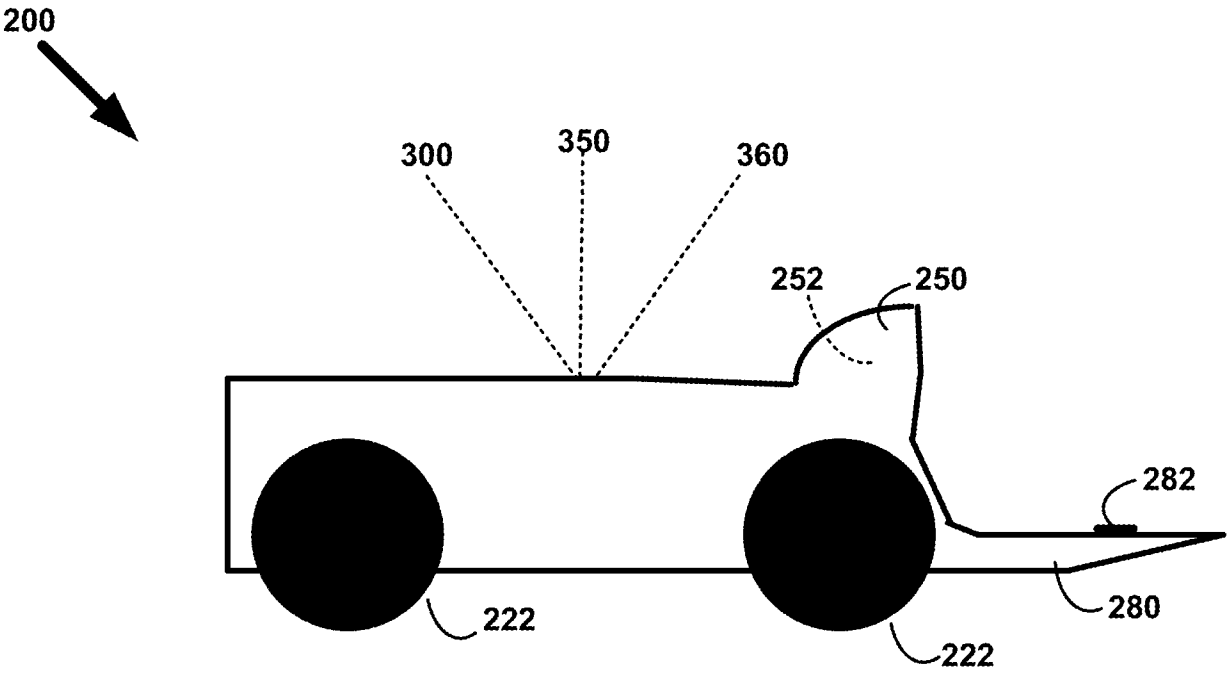
FIG. 3 is a side view diagram illustrating an example of the mounting structure of FIG. 2.

FIG. 2 is a side view diagram illustrating an example of the apparatus 100 with a fully raised and extended loader assembly 600 and a cab assembly 400 facing the loader assembly 600. This is the configuration of the apparatus 100 that will often occur immediately prior to loading cargo 70 onto the loader assembly 600. This drawing also illustrates an example of three core assemblies of the apparatus 100, a mounting structure 200, a cab assembly 400, and a loader assembly 600, A. Mounting Structure FIG. 3 is a side view diagram illustrating an example of the mounting structure 200 of FIG. 2. The mounting structure 200 can be comprised of a base member 210 and variety of different motion-enabling components 220 such as wheels 222 or treads 226. The base member 210 can include a loader base 250 to support the loader assembly 600 (with a vertical pivot point 252) and a cab base 280 (with a horizontal rotation point 282).

The mounting structure 200 can also include components such as an engine 300 (typically a turbo-charged engine 310 that is a diesel engine 320), a transmission 350 (such as a hydrostatic transmission 352 with predefined speed ranges 354 and an auto-shift capability 356). Some embodiments of the mounting structure 200 can include a speed management assembly 360, a dynamic brake 370, an inching pedal 372, a mechanical gearbox (such as a four-speed mechanical gearbox 376).

B. Bi-Directional Cab Assembly

Figure 4:
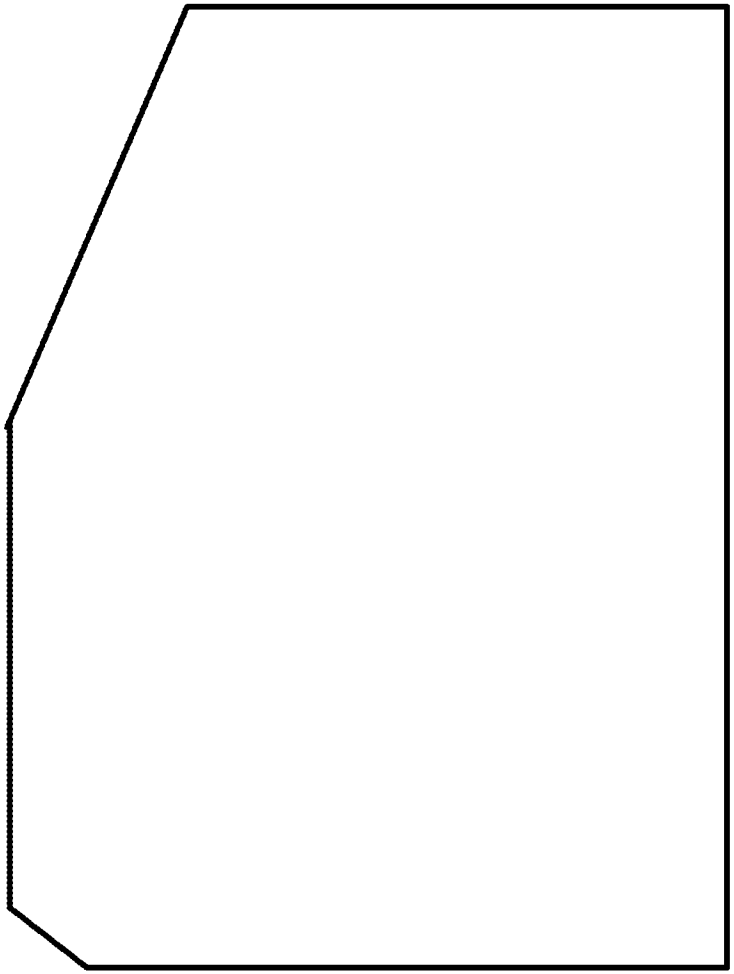
FIG. 4 is a side view diagram illustrating an example of the cab assembly of FIG. 2.

FIG. 4 is a side view diagram illustrating an example of the cab assembly of FIG. 2. FIG. 4A is a side view diagram illustrating an example of a cab assembly 400 that includes a seat 460, various controls 450, a window 430, and a work light 420. The cab assembly 400 can also include components such as pillars 440, sensors 470 (such as cameras 472), displays 474, and other technologies that could be useful to an operator 90 of the apparatus 100.

The cab assembly 400 can rotate up to about 180 degrees on the horizontal rotation point 282, enabling the operator 90 to always face the direction in which the apparatus 100 is being driven.

Figure 4B:
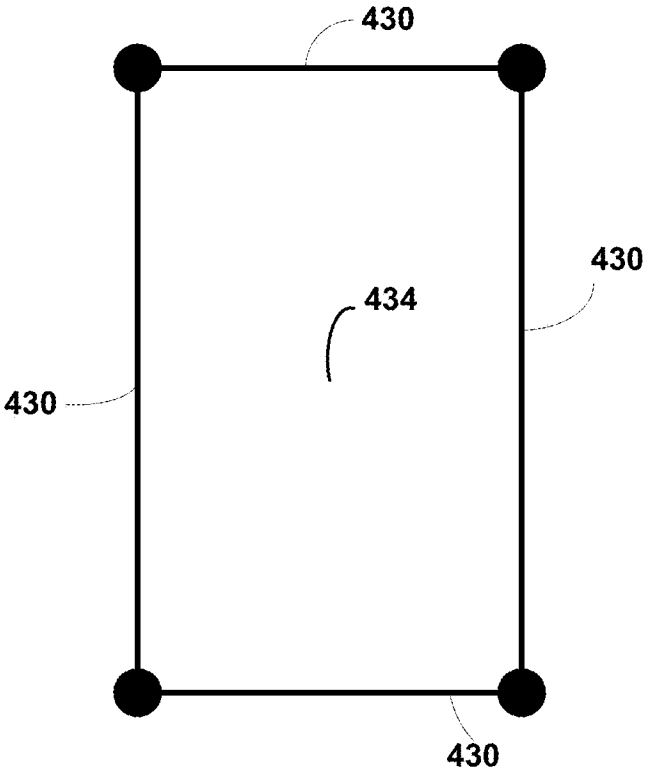
FIG. 4B is a top view diagram illustrating an example of a cab assembly.
Figure 4A:
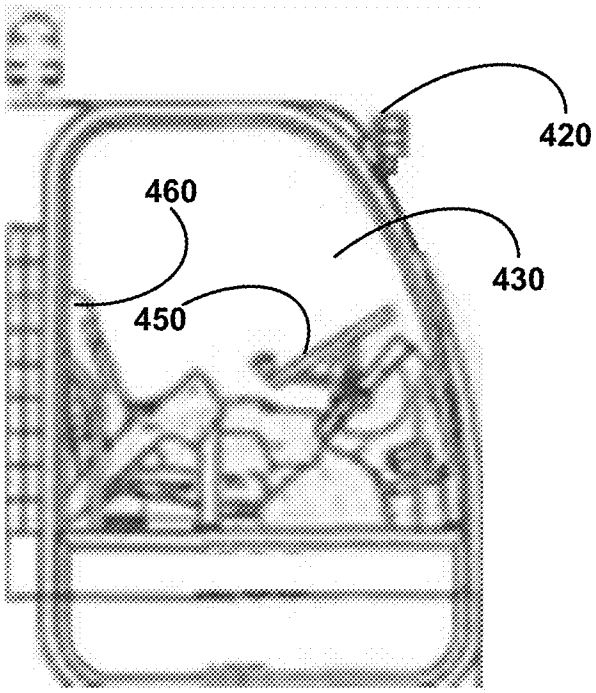
FIG. 4A is a side view diagram illustrating an example of a cab assembly.

FIG. 4B is a top view diagram illustrating an example of a cab assembly 400 this is comprised of four windows 430 positioned with four pillars 440. Different embodiments of the cab assembly can utilize different structures to put a roof over the cab assembly, to permit the operator 90 to see the external operating environment, and to keep the exterior environment outside of the cab assembly 500.

C. Loader Assembly

Figure 5A:
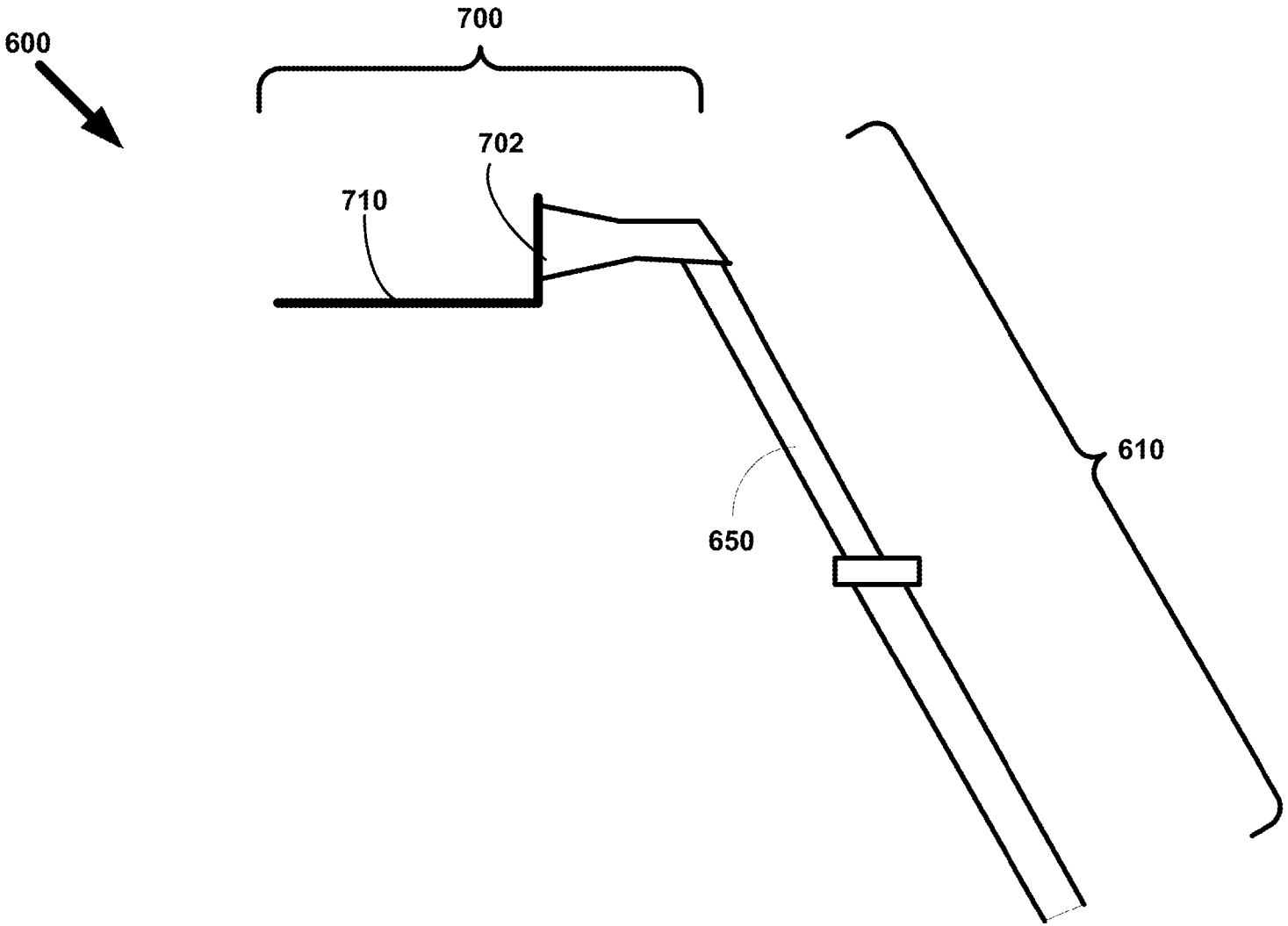
FIG. 5A is a side view diagram illustrating an example of a loader assembly in a fully raised position.

FIG. 5A is a side view diagram illustrating an example of a loader assembly 600 in a fully raised position. The loader assembly 600 can itself be divided into two primary subassemblies, the boom 610 and the loader 700. The loader 700 includes the roll 702 and the fork 710.

Figure 5B:
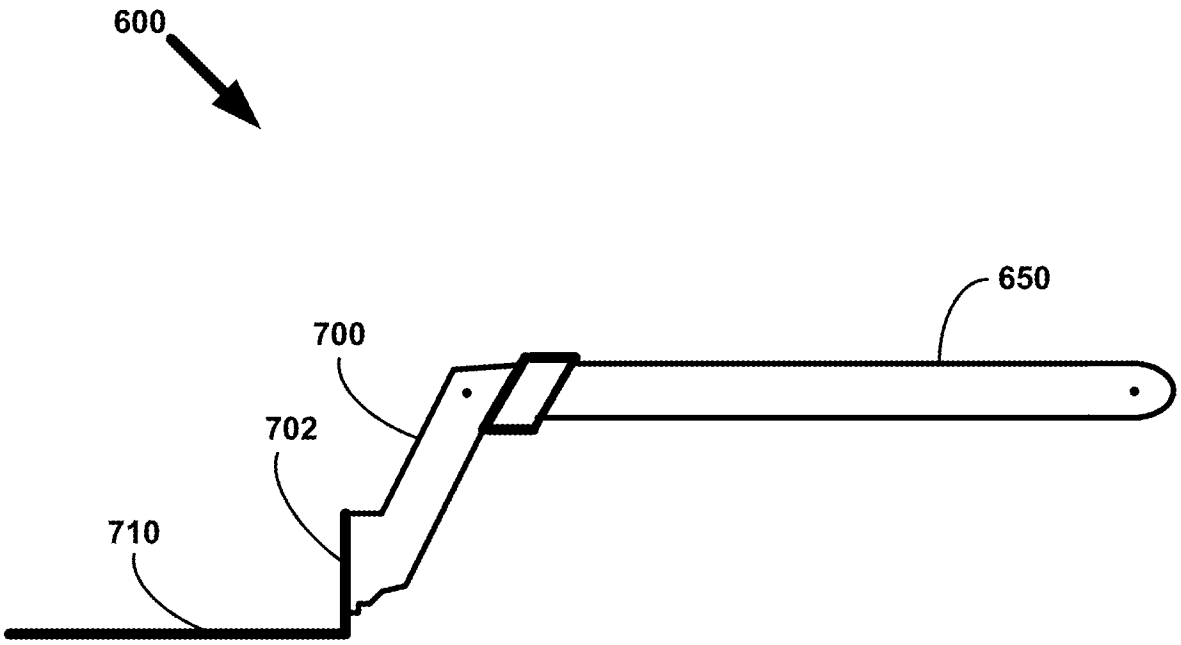
FIG. 5B is a side view diagram illustrating an example of a loader assembly in a fully lowered position.

FIG. 5B is a side view diagram illustrating an example of a loader assembly 600 in a fully lowered position. The Figure specifically identifies the fork 710 and roll 702 of the loader 700, as well as the loader arm/handler 650.

Figure 5C:
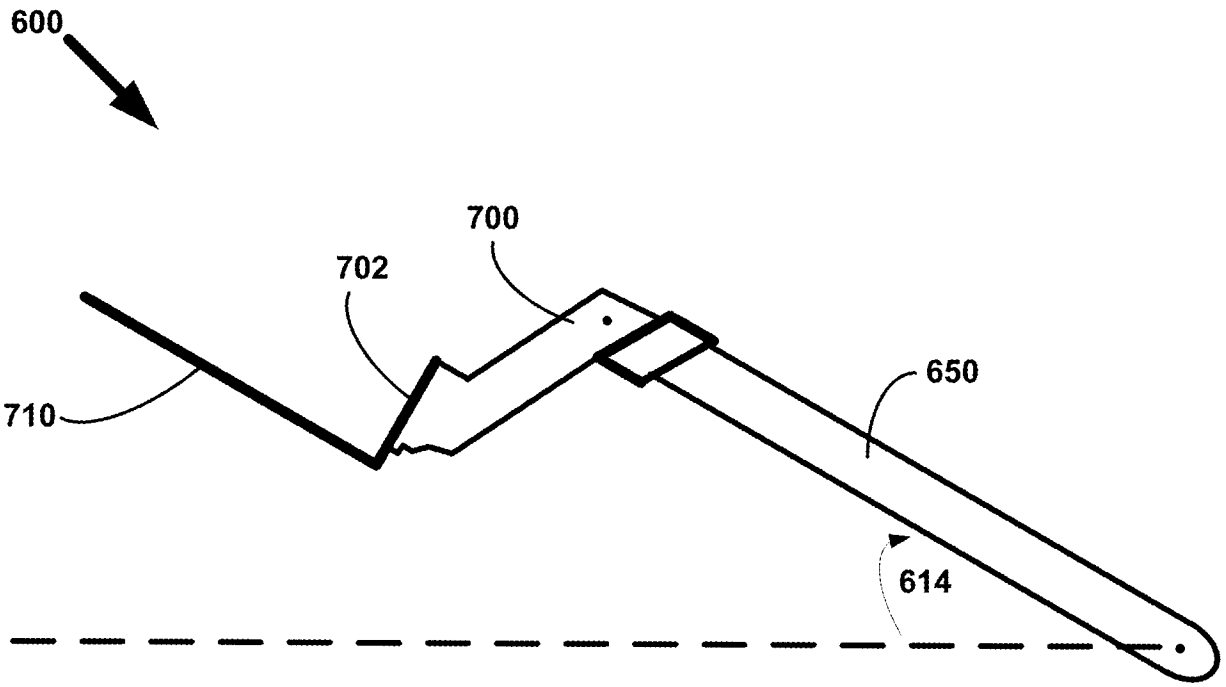
FIG. 5C is a side view diagram illustrating an example of a loader assembly in a vertical position that is between FIG. 5A and FIG. 5B.

FIG. 5C is a side view diagram illustrating an example of a loader assembly 600 in a vertical position that is between FIG. 5A and FIG. 5B.

Figure 5D:
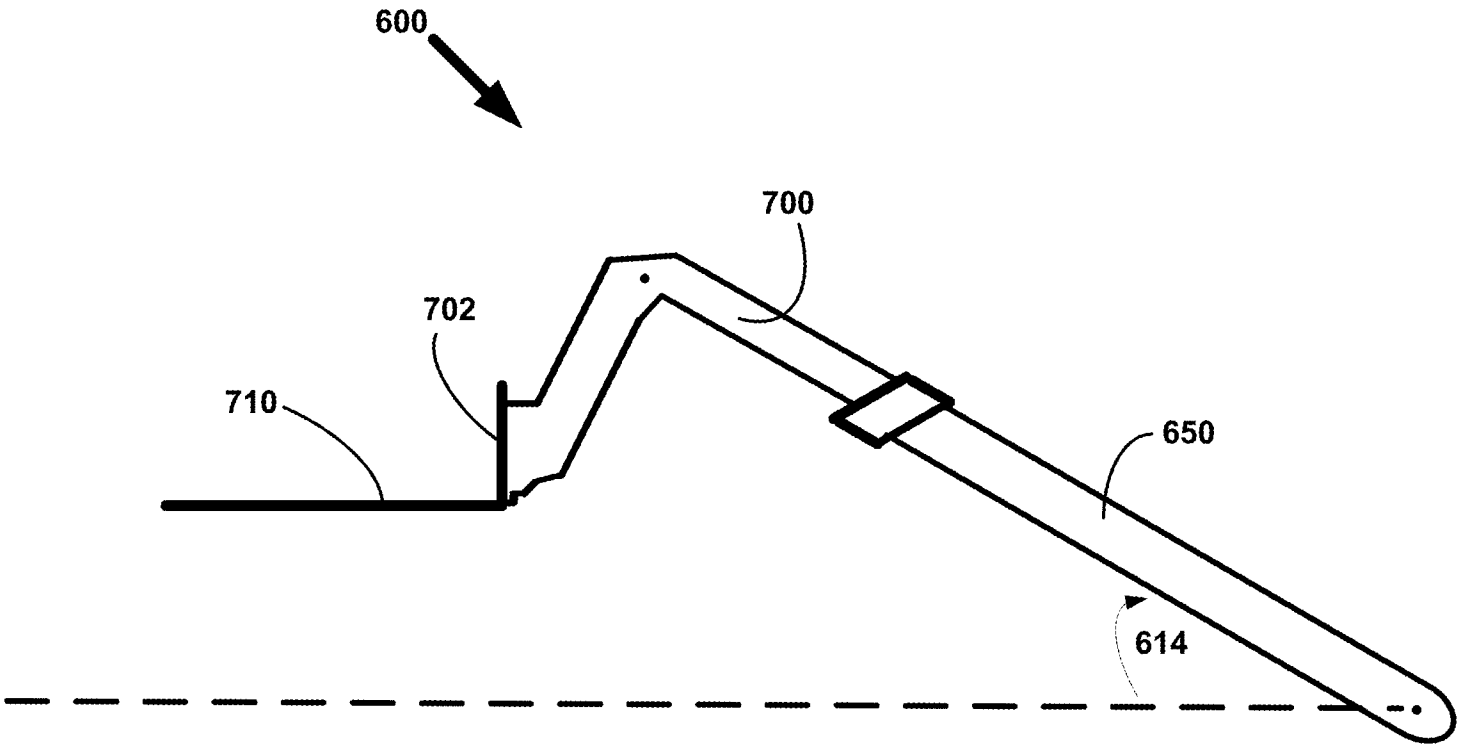
FIG. 5D is a side view diagram illustrating an example of a loader assembly similar to the example in FIG. 5C, except that the fork is level (i.e. parallel with the ground).

FIG. 5D is a side view diagram illustrating an example of a loader assembly similar to the example in FIG. 5C, except that the fork is level (i.e. parallel with the ground).

There are many potential variations to the loader assembly 600 that can be incorporated into the apparatus 100. Subject to the geometric/dimensioning constraints that motivated the conception of the apparatus 100, virtually any prior art loader assembly 600 can be incorporated into the apparatus 100.

V. Flow Chart Views

The apparatus 100 can be used in a variety of different processes for the loading and unloading of cargo 70.

A. Loading Process

Figure 6A:
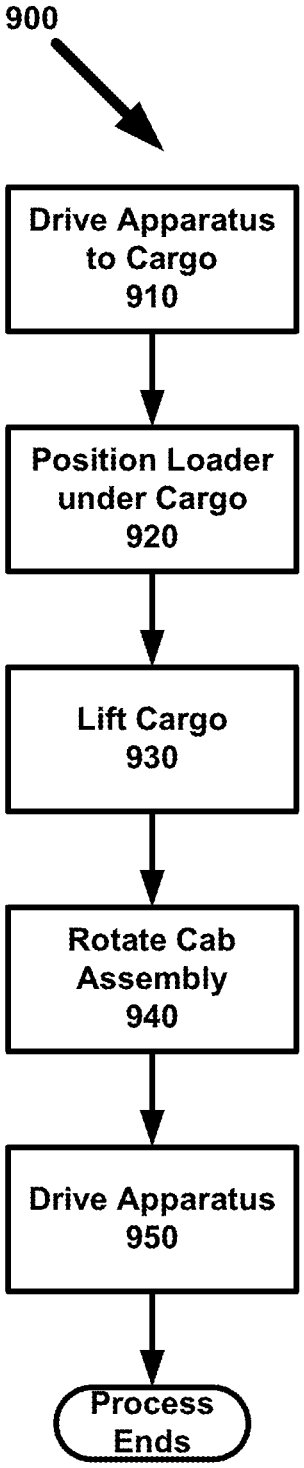
FIG. 6A is a flow chart diagram illustrating an example of a method for loading the apparatus.

FIG. 6A is a flow chart diagram illustrating an example of a method 900 for loading the apparatus 100.

At 910, the apparatus 100 is driven to the cargo 70.

At 920, the loader assembly 600 (or more specifically a portion of the loader assembly 600 such as a fork 710) is positioned under the cargo 70.

At 930, the cargo 70 is lifted by the loader assembly 600 of the apparatus 100.

At 940, the cab assembly 400 is rotated 180 degrees.

At 950, the apparatus 100 (with the cargo 70 on the loader assembly 600) drives off in the direction that the cab assembly 400 is facing.

B. Unloading Process

Figure 6B:
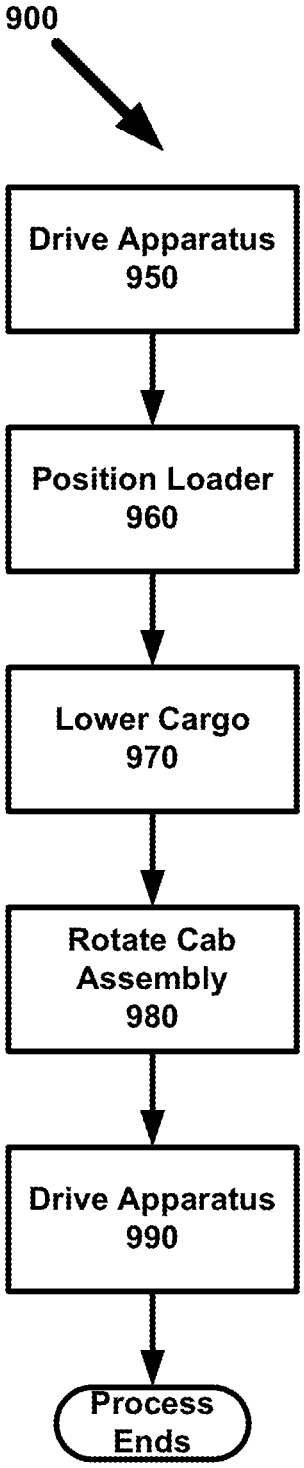
FIG. 6B is a flow chart diagram illustrating an example of a method of unloading the apparatus.

FIG. 6B is a flow chart diagram illustrating an example of a method 900 of unloading the apparatus 100.

At 950, the apparatus 100 (with the cargo 70 on the loader assembly 600) drives off in the direction that the cab assembly 400 is facing. The apparatus 100 is driven to the destination location for the cargo 70.

At 960, the loader assembly 600 is positioned.

At 970, the loader assembly 600 lowers the cargo 70, unloading the cargo 70.

At 980, cab assembly 400 rotates up to about 180 degrees so that the apparatus 100 can "back-up" with the operatory 90 facing the direction being driven.

At 990, the apparatus 100 is driven away, driving in the direction that the operator 90 is facing (which is also the direction that the cab assembly 400 faces).

VI. Modes and Positions

Figure 7A:
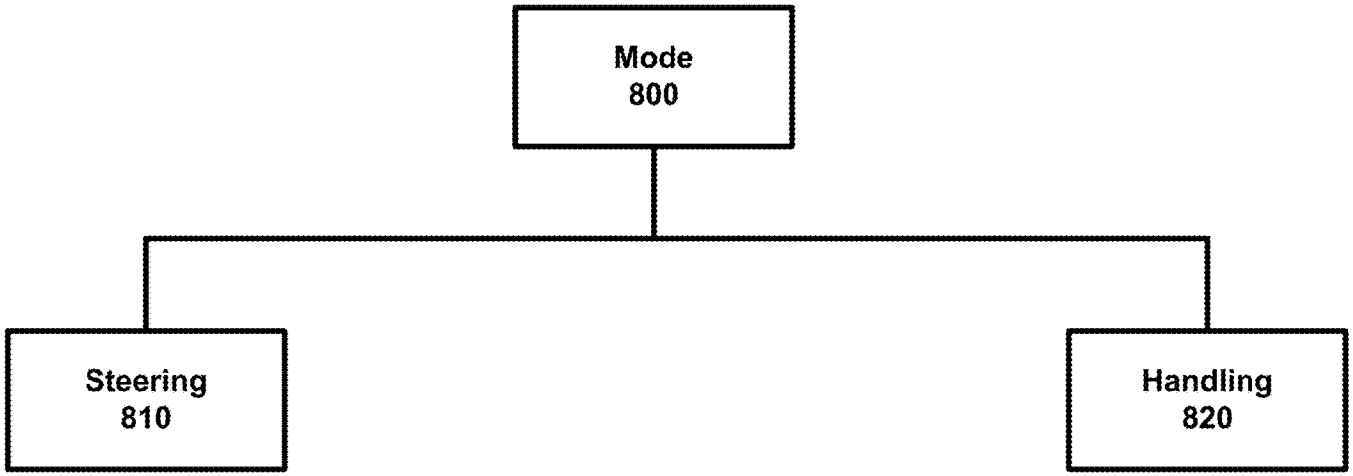
FIG. 7A is a hierarchy diagram illustrating examples of different operating modes for the apparatus.

FIG. 7A is a hierarchy diagram illustrating examples of different operating modes 800 for the apparatus 100. Operating modes can include a steering mode 810 and a handling mode 820. In many embodiments of the apparatus 100, the apparatus 100 cannot be driven while the loader assembly 600 is moving relating to the apparatus 100 and the loader assembly 600 cannot be moved relative to the apparatus 100 when the apparatus 100 is being driven.

Figure 7B:
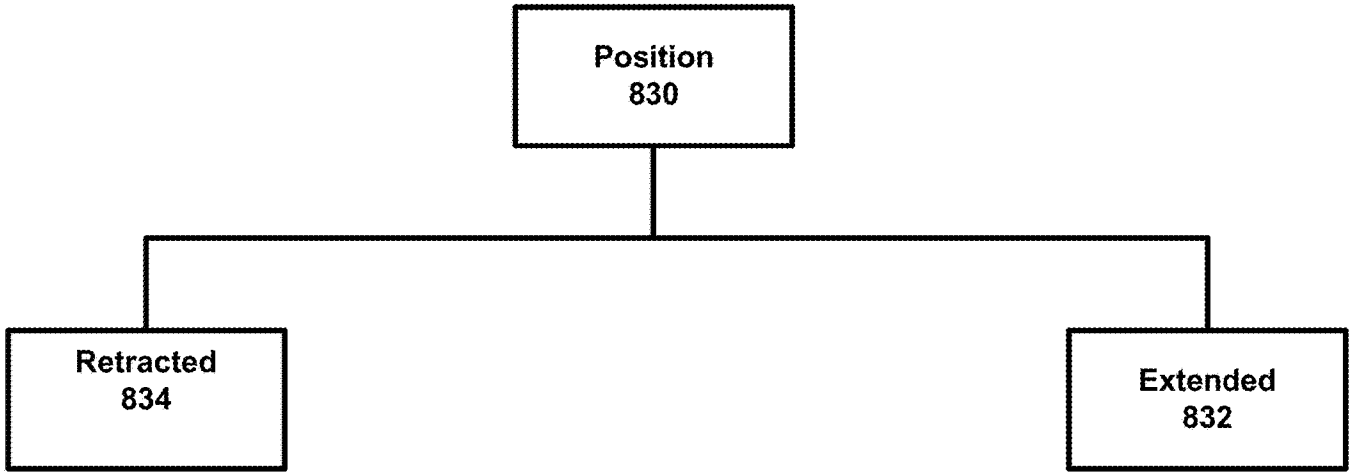
FIG. 7B is a hierarchy diagram illustrating examples of different operating modes for the apparatus.

FIG. 7B is a hierarchy diagram illustrating examples of different positions 830 for the apparatus 100. Positions 830 can include retracted 834 as well as extended 832. An example of a loader assembly 600 in a fully retracted state is shown in FIG. 1C. An example of a loader assembly 600 in a fully extended state is shown in FIG. 2. There are many potential hybrid positions 830 within those two end points. In some embodiments of the apparatus 100, preset positions 830 can be programmed into the apparatus 100 and/or saved, so that for example, if the fork 710 needs to be a certain height every time to remove cargo from the second level of a bi-level auto-rack, the loader assembly 600 will automatically go to the desired height upon the applicable action by the operator 90 using the applicable control.

Figure 7C:
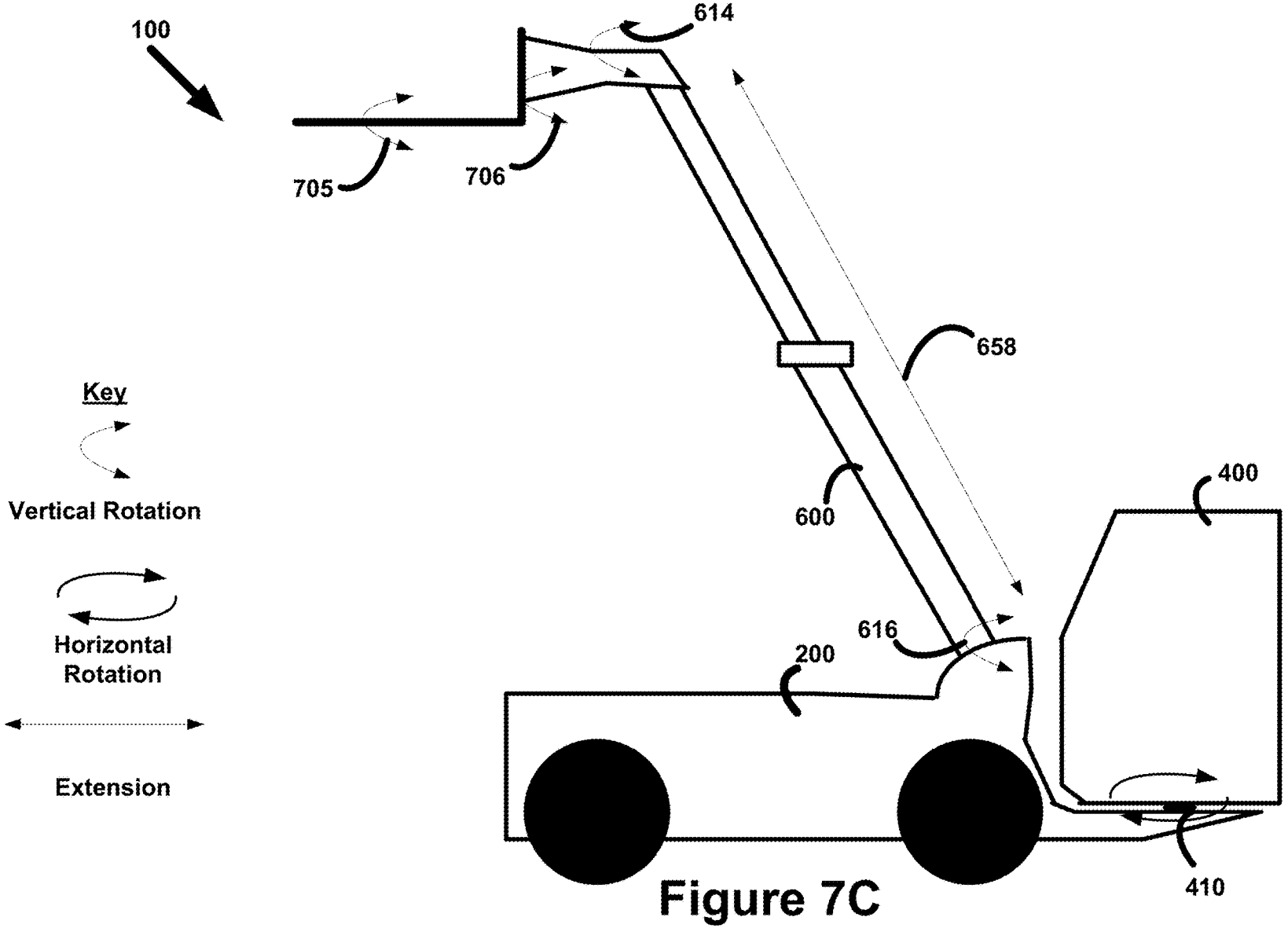
FIG. 7C is a side view diagram illustrating an example of different parts of the apparatus capable of horizontal or vertical movement relative to the apparatus.

FIG. 7C is a side view diagram illustrating an example of different parts of the apparatus 100 capable of horizontal or vertical movement relative to the apparatus 100. The Figure also shows parts of the apparatus 100 that can elongate and/or contract.

Points of vertical rotation include the turret 616, fork roll 705, and fork tilt 706. Points of horizontal rotation can include the cab assembly 400 at 410, and left/right rotation at 614. Elongation and contraction can be implemented in the telescopic extension 650.

VII. Detailed Drawings

A mounting structure 200 for attaching a bi-directional cab assembly 400 at the end of a loader assembly 600 with telescopic handlers to a skid steer loader of the bi-directional type, the structure mounting the cab at the end behind the skid steer loader with the cab rotating in a turning radius of 180° direction and accommodating small spaces for easy movement of the head to a trailing transport mode behind the skid steer loader when traveling in a direction opposite to the skid steer loader' direction. The mounting structure is carried by the skid steer loader which, in the operational mode of the skid steer loader. The mounting structure allows use of a skid steer loader head on a bi-directional cab which may be of the center articulated type, so that when moving in one direction, normal skid steer loader is carried out, but the bi-directional skid steer loader can assume a trailing travel mode when the bi-directional skid steer loader is driven in the opposite direction, thus allowing the machine to occupy considerably less width. Also, because the bi-directional skid steer loader is centrally disposed behind the skid steer loader head, the skid steer loader can be designed to lay a windrow at a distance from the end of the skid steer loader and yet in a position which will avoid being back-up travel in the skid steer loader. Bi-directional cab and skid steer loader combined with apparatus performing additional operations while loading transportation convenience in small spaces of rail cars and trailers gathering or loading material for transporting.

A device suitable for the use with rail car or shipping commodities that can be used to load various goods in heretofore unutilized empty car-hauling containers and an integrated system employing the same. The device includes a base member configured to engage the loading supporting the bi-directional loader. in the transport vehicle, the vehicle includes smoothly operable controls and a safety user-positioning method. The vehicle further includes a power source rapid disconnection and connection system for recharge and replacement and for secure connection. Also, the vehicle may include a safety speed regulator, and a bi-directional safety braking system. Further, the vehicle includes a preferential drive sharp-turns enabling system. The vehicle further includes an initially-flat indicia-applicable cowling. It may also include a protective security lock, a further or alternative braking system, and may be readily separable for shipping.

Figure 8B:
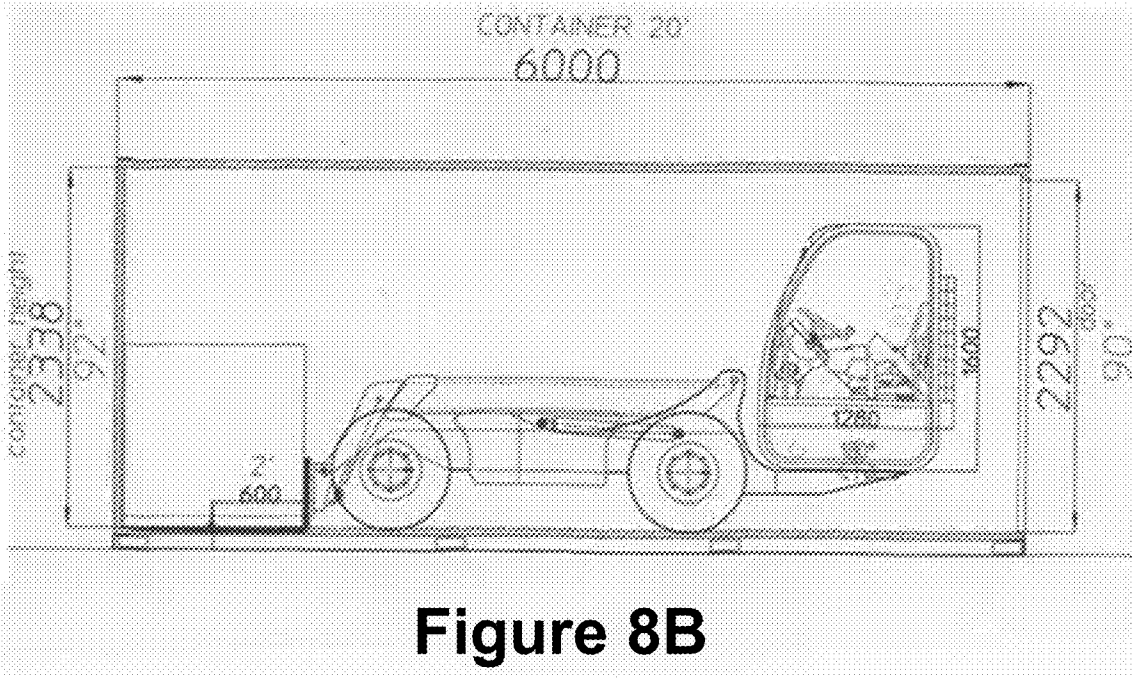
FIG. 8B is a side view diagram illustrating an example of the apparatus.
Figure 8A:
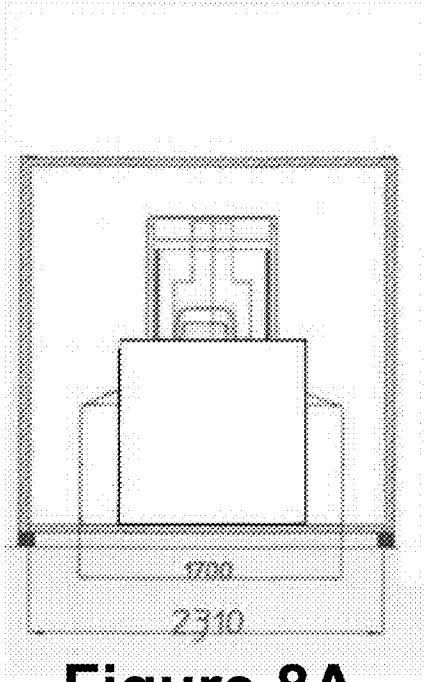
FIG. 8A is a front view diagram illustrating an example of the apparatus.

FIG. 8A is a front view diagram illustrating an example of the apparatus 100 with cargo 70 in the loader assembly 600.

FIG. 8B is a side view diagram illustrating an example of the apparatus 100 with cargo 70 in the loader assembly 600.

Figure 8D:
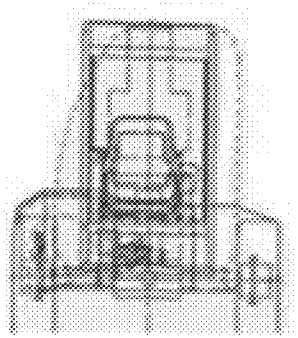
FIG. 8D is a front view diagram illustrating an example of the apparatus that corresponds with FIG. 8C.
Figure 8C:
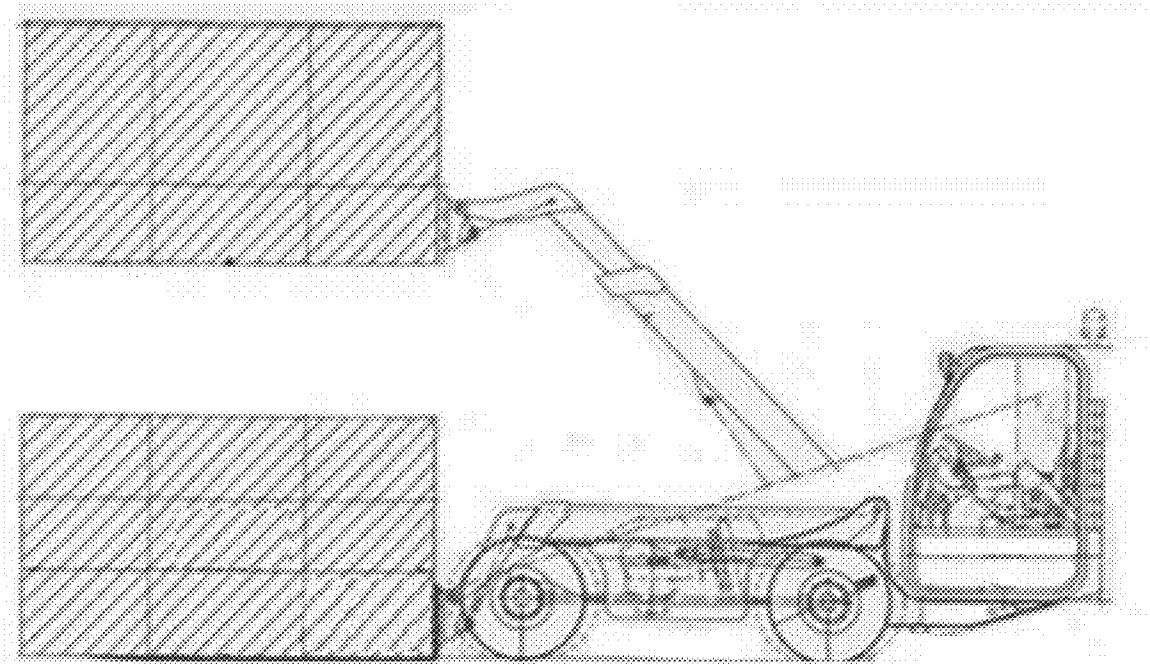
FIG. 8C is a side view diagram illustrating an example of the apparatus and range of vertical motion that the loader assembly of the apparatus can have.

FIG. 8C is a side view diagram illustrating an example of the apparatus 100 and range of vertical motion that the loader assembly 600 that some embodiments of the apparatus 100 can have.

FIG. 8D is a front view diagram illustrating an example of the apparatus 100 that corresponds with FIG. 8C.

Figure 8F:
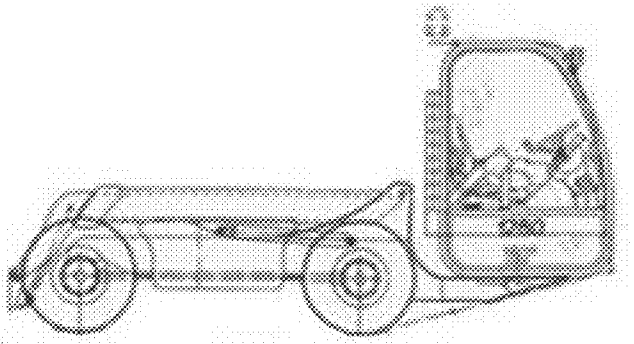
FIG. 8F is a side view diagram illustrating an example of the apparatus that corresponds with FIG. 8E.
Figure 8E:
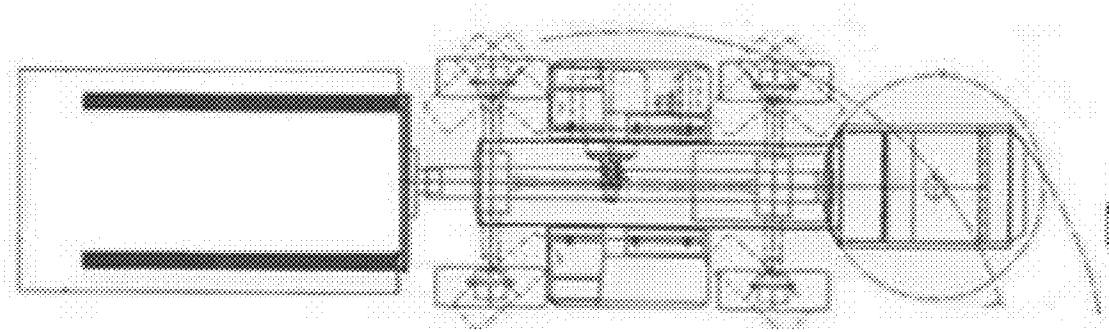
FIG. 8E is a top view diagram illustrating an example of the apparatus.

FIG. 8E is a top view diagram illustrating an example of the apparatus 100. The cab assembly 400 is facing away from the cargo 70 and the cab assembly 400 is facing the direction that the apparatus 100 is being driven.

FIG. 8F is a side view diagram illustrating an example of the apparatus 100 that corresponds with FIG. 8E. The cab assembly 400 has been rotated to face the direction in which the apparatus 100 is being driven.

Figure 8G:
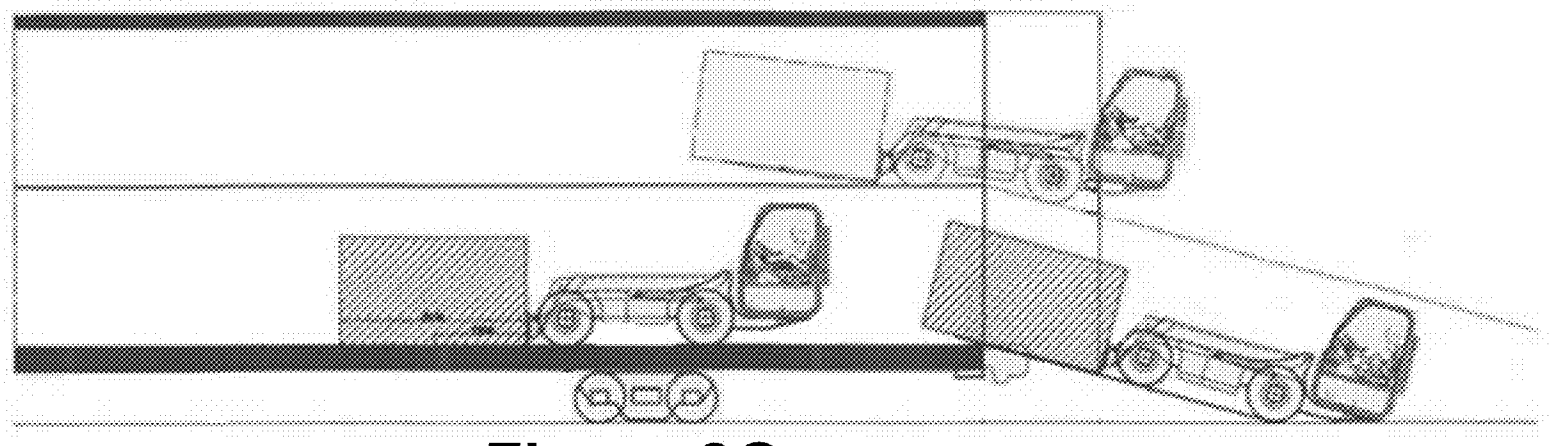
FIG. 8G is a side view diagram of the apparatus loading cargo into a bi-level railcar.

FIG. 8G is a side view diagram of the apparatus loading cargo into a bi-level railcar. As illustrated in the Figure, the apparatus 100 is small enough to fit into bi-level auto-rack. The apparatus 100 can drive into the railcar with the driver facing the direction that the apparatus 100 is driving, and the apparatus 100 can drive out of the railcar with the driver facing the direction that the apparatus 100 is driving because the cab assembly 400 can vertically rotate up to about 180 degrees.

Figure 8H:
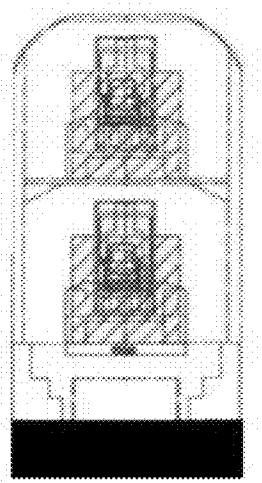
FIG. 8H is a front view diagram of the apparatus that corresponds to FIG. 8G.

FIG. 8H is a front view diagram of the apparatus that corresponds to FIG. 8G. As illustrated in the Figure, the apparatus 100 fits within the bi-level auto rack.

Figure 8I:
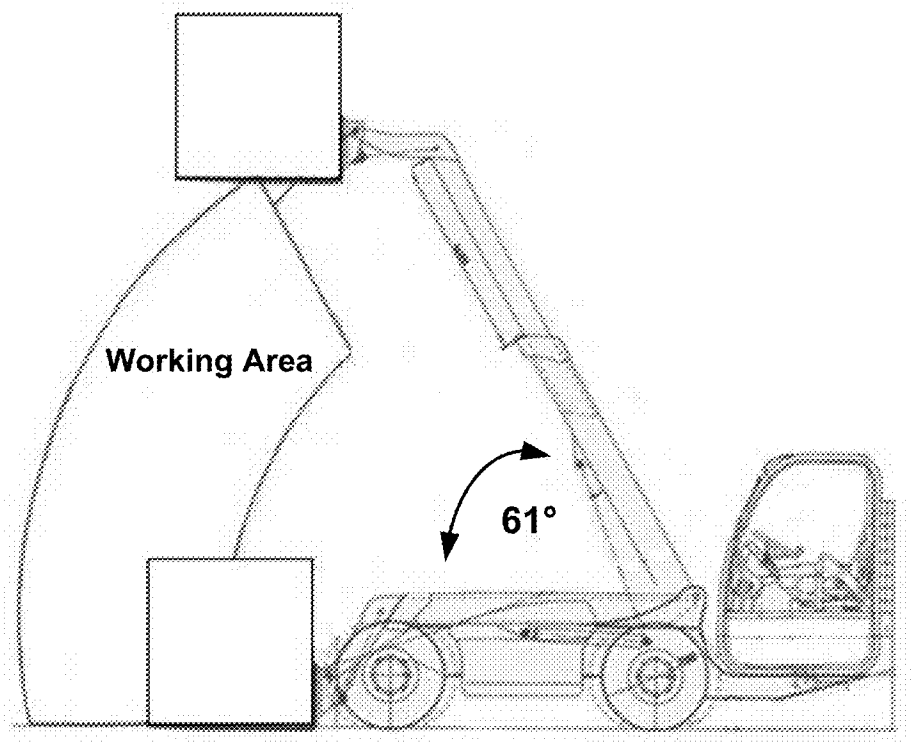
FIG. 8I is a side view diagram of the apparatus that illustrates an example of the loader assembly moving between a fully raised and fully lowered position.

FIG. 8I is a side view diagram of the apparatus 100 that illustrates an example of the loader assembly 600 moving between a fully raised and fully lowered position 830.

A. Apparatus with 180 Degree Turning Radius

The 180° turning path of the apparatus 100 measures the minimum possible turning radius needed when designing parking, loading, and drop-off spaces in a railroad auto rack. Measuring the inner and outer radii of the 180° turn, a minimum inner radius of 8'7"|5.3 m and minimum outer radius of 7'4"|5.3 m should be provided. Though the turning path requires a width of only 7'6"|2.3 m, additional clearances should be provided whenever possible to accommodate a larger variety of pallet sizes and driver abilities.

The turning path of an auto rack sized length of 89'4" measures the possible turning radius necessary for performing a 180° turning path in an auto rack with an 8'7'"|5.3 m height. Measuring the inner and outer radii of the 180° turn, a minimum inner radius of 8'7"|5.3 m and minimum outer radius between containers should be provided for medium-sized pallets.

B. Mounting Structure

Designed for Skid Steers/Compact Tool Carriers, allowing standard size skid steer attachments to be connected. The adapter is designed to fit any unit with the "universal mini mount". This adapter provides greater versatility in terms of choice of attachments. In addition, the operator 90 can easily switch attachments between a standard skid steer loader and a mini skid steer, resulting in greater functionality, while offering the owner a low cost of ownership.

Unlike a conventional front loader, the lift arms in the machines are alongside the driver with the pivot points behind the operator's 90 shoulders. Because of the operator's 90 proximity to moving booms 610, the apparatus 100 has positioned the operator 90 behind the skid loaders with a rotating cab and safer than a conventional front loader, particularly during entry and exit of railcars or rail auto racks. This new rotating cab assembly 400 is preferably a fully enclosed cab and other features to protect the operator 90. Like other front loaders, it can push material from one location to another, carry material in on its forks 710 or load material into a railcar 60 or rail auto rack 62.

C. Cab Assembly with 180 Degree Rotation Capability

Fully Enclosed Rotating Cab with hydraulic rotation cab axe scope on a Skid Steer loader. For extra safety and comfort, B-Directional Cab Assembly 400 can be equipped with work lights and positioned on the top of the cabin (2 in front and 2 at the rear). Gives the visibility to work in dark environments or finish in total safety. The Bi-Directional rotating cab design with high-resistance full-glass enclosure gives a spacious work environment, unbeatable 180° visibility and superior range of vision. The concept can use a four or five-pillar cab design, leaving both sides free from blocking structures while still offering maximum protection.

D. Turbo-Charged Engine

The diesel engine can meet strict emission regulations in various markets, while delivering superior fuel economy and overall efficiency with reliability has long provided the two engines the 4TN101 and 4TN107 has the experience in cutting-edge diesel engine technology, and with the very best high-power, fuel-efficient diesel engines that can be incorporated into the apparatus 100.

E. Heavy-Duty Telescopic Loaders

Telescopic Loaders can provide the apparatus 100 with a heavy-duty hydrostatic transmission that delivers smooth power quickly, with high wheel torque for loading and pushing. Operation can be safe and easy, with many additional features to help you get the job done quickly and efficiently: two speed ranges with shift-on-the-fly, auto-shift functionality during heavy load conditions, speed management system, dynamic braking and an inching pedal, also a 4-speed mechanical gearbox to optimize speed and torque for each load or unload.

F. Telescopic Handler

For durability and working on the most intensive auto racks, the telescopic handler is equipped with heavy-duty axles. The heavy-duty axles and central differential gear, service brakes in oil bath, 3 planetary gears in hubs, one steering cylinder protected in upper position, position sensor to re-align wheels when changing the steering mode.

Moving materials, loading containers with several types and sizes, handling container with self-leveling forks, lifting containers with standard automatically levels the folks or attachment as the boom is raised eliminating the need for manual adjustments. The Bi-Directional telehandlers become multi-functional machine for loading Auto-Racks (Bi-Level, Tri-Level) lift higher, lift heavier, lift safer range and movements of the Bi-Directional loader.

G. Boom

Handling container loads can be tricky inside railcars, auto racks even for experienced operators. For the comfort and safety, the bi-directional rotating loader with a boom cushion system that allows a smoother motion when the boom is close to min and max angles, or close to full retraction.

H. Skid-Steer Loader

The design, balance and weight distribution are perfected to deliver more usable horsepower, powerful breakout forces and faster cycle times. With a Bi-Directional skid steer loader we can work in smaller places and with the rotating cab turning 1800 radius the turning, makes it extremely maneuverable and valuable for loading railcars and auto rail racks that require a compact, agile loader and this Bi-Directional loader can left height of 19'1" containers in tight spaces.

I. Lift Arms

Container floating forks can move container/pallets more quickly and efficiently and are safe and easy to operate. Mounted on a carriage with a backrest and independent oscillating bars, they are free to swing while remaining level with the ground. They make it easier to slot the forks into the container/pallet openings, without having to adjust the tilt angle and height as much as with any fixed forks.

The invention claimed is:

1. An apparatus (100) driven by a user (90) for moving a cargo (70), said apparatus (100) comprising:

a mounting structure (200), said mounting structure (200) including a loader base (250), a cab base (280), and a plurality of motion-enabling components (220) adapted for moving said apparatus (100);

a cab assembly (400) positioned on said cab base (280), said cab assembly including a seat (460) and a plurality of controls (450) for a user (90), wherein said cab assembly (400) further includes a horizontal rotation range (284) of between about 0 and 180 degrees;

a load assembly (600) positioned on said loader base (250), said loader assembly (600) including a boom (610), a lift arm (650), and a loader (700); and wherein said cab assembly (400) is adapted to horizontally rotate from a fixed position along a vertical axis independently of said loader assembly (600).

2. The apparatus (100) of claim 1, wherein said boom (610) includes a boom angle (614) between about 0 and 90 degrees.

3. The apparatus (100) of claim 1, wherein said loader (700) is a telescopic loader (710) with a plurality of self-leveling forks (722).

4. The apparatus (100) of claim 1, wherein said plurality of controls (450) is adapted to operate said apparatus (100) in a plurality of operating modes (800).

5. The apparatus (100) of claim 4, wherein said plurality of operating modes (800) includes a steering mode (810) and a handling mode (820).

6. The apparatus (100) of claim 1, wherein said cab assembly (400) further includes a plurality pillars (440) and a plurality of windows (430), wherein each said window (430) is connected to at least two said pillars (440).

7. The apparatus (100) of claim 1, wherein said cab assembly (400) is positioned to the exterior of all said plurality of motion-enabling components (220).

8. The apparatus (100) of claim 1, wherein said cab assembly (400) further includes a sensor.

9. The apparatus (100) of claim 1, wherein said mounting structure (200) further includes an engine (300), a transmission (350) and a speed management subassembly (360).

10. The apparatus (100) of claim 9, wherein said engine (300) is a turbo-charged engine (310) that utilizes a diesel (320) fuel, wherein said transmission (350) is a hydrostatic transmission (352) that includes an auto-shift (356) and wherein said speed management subassembly (360) includes a dynamic brake (370), an inching pedal (372), and a 4-speed mechanical gearbox (376).

11. The apparatus (100) of claim 1, wherein said boom (610) includes a cushion subassembly (612) and a boom angle (614) between about 0 and 90 degrees.

12. The apparatus (100) of claim 1, wherein said apparatus (100) is adapted to be driven inside an auto-rack (60).

13. The apparatus (100) of claim 1, wherein said apparatus is adapted to be driven inside an auto-rack (60) that is a bi-level auto rack (60).

14. The apparatus (100) driven by a user (90) for moving a cargo (70), said apparatus (100) comprising:

a mounting structure (200), said mounting structure (200) including a loader base (250), a cab base (280), a turbo-charge engine (310) powered by a diesel (320) fuel, a hydro-static transmission (352) with an auto-shift (356), a speed management subassembly (360) that includes a dynamic brake (370) and an inching pedal (372), and a plurality of wheels (222);

a cab assembly (400) positioned on said cab base (280), said cab assembly including a seat (460), a plurality of pillars (440), a plurality of windows (430), and a plurality of controls (450) for a user (90), wherein said cab assembly (400) further includes a horizontal rotation range (284) of between about 0 and 180 degrees;

a loader assembly (600) positioned on said loader base (250), said loader assembly (600) including a boom (610) with a cushion subassembly (612) and a boom angle (614) between 0 and 90 degrees, a lift arm (650) that is a telescopic lift arm (656) with a turn radius of about 0 degrees and a tilt angle (654) between 0 and 90 degrees, and a loader (700) comprising a plurality of self-leveling forks (722);

wherein said cab assembly (400) is adapted to horizontally rotate from a fixed position along a vertical axis independently of said loader assembly (600); and wherein said apparatus (100) includes a plurality of operating modes (800) and said loader assembly (600) includes a plurality of positions (830), said plurality of operating modes (800) comprising a steering mode (810) and a handling mode (820), said plurality of positions (830) including a fully extended position (832) and a fully retracted position (834).

15. A method (900) of loading a cargo (70) into a container (80), said method (900) comprising:

driving (910) an apparatus (100) that includes a plurality of wheels (220) to a location of the cargo (70);

positioning (920) a plurality of self-leveling forks (714) underneath the cargo (70);

lifting (930) the cargo (70) by extending a loader assembly (600) of the apparatus (100), wherein said loader assembly (600) includes said plurality of self-leveling forks (714);

rotating (940) a cab assembly (400) of said apparatus (100) about 180 degrees, wherein said cab assembly (400) is adapted to horizontally rotate from a fixed position along a vertical axis independently of said loader assembly (600);

driving (950) said apparatus (100) to a container (80);

rotating (960) said cab assembly (400) 180 degrees; and lowering (970) said cargo (70) into the container (80) by retracting the loader assembly (600) of the apparatus (100).

16. The method (900) of claim 15, wherein said container (80) is a collapsible container (84) and where the cargo is not a vehicle.

17. The method (900) of claim 15, wherein said loader assembly (600) includes a boom angle (614) between 0 and 90 degrees.

18. The method (900) of claim 16, wherein said loader assembly (600) includes a turn radius (652) of about zero degrees and a tilt angle (654) between 0 and 90 degrees.

19. The method (900) of claim 15, said apparatus (100) comprising:

a mounting structure (200), said mounting structure (200) including a loader base (250), a cab base (280), and said plurality of wheels (220) adapted for moving said apparatus (100);

said cab assembly (400) positioned on said cab base (280), said cab assembly including a seat (460) and a plurality of controls (450) for a user (90), wherein said cab assembly (400) further includes a horizontal rotation range of 180 degrees;

said loader assembly (600) positioned on said loader base (250), said loader assembly (600) including a boom (610), a lift arm (650), and said plurality of self-leveling forks (714).

* * * * *